US008655478B2

(12) United States Patent
Fukuda et al.

(10) Patent No.: US 8,655,478 B2
(45) Date of Patent: Feb. 18, 2014

(54) DRESSING METHOD, METHOD OF DETERMINING DRESSING CONDITIONS, PROGRAM FOR DETERMINING DRESSING CONDITIONS, AND POLISHING APPARATUS

(75) Inventors: Akira Fukuda, Tokyo (JP); Yoshihiro Mochizuki, Tokyo (JP); Yutaka Wada, Tokyo (JP); Yoichi Shiokawa, Tokyo (JP); Hirokuni Hiyama, Tokyo (JP)

(73) Assignee: Ebara Corporation, Tokyo (JP)

( * ) Notice: Subject to any disclaimer, the term of this patent is extended or adjusted under 35 U.S.C. 154(b) by 405 days.

(21) Appl. No.: 12/566,224

(22) Filed: Sep. 24, 2009

(65) Prior Publication Data

US 2010/0081361 A1 Apr. 1, 2010

(30) Foreign Application Priority Data

Sep. 26, 2008 (JP) ..... 2008-247450

(51) Int. Cl.

| | |
|---|---|
| ***G06F 19/00*** | (2011.01) |
| ***G05B 11/01*** | (2006.01) |
| ***G05B 19/18*** | (2006.01) |
| ***B24B 49/00*** | (2012.01) |
| ***B24B 1/00*** | (2006.01) |
| ***G01D 1/00*** | (2006.01) |

(52) U.S. Cl.

USPC ..... 700/164; 700/13; 700/64; 700/171; 451/5; 451/56; 451/443; 702/127

(58) Field of Classification Search

CPC ..... B24B 49/00
USPC ..... 451/5, 56, 443; 700/13, 64, 69, 171, 700/161; 702/148

See application file for complete search history.

(56) References Cited

U.S. PATENT DOCUMENTS

| | | | | |
|---|---|---|---|---|
| 5,599,423 | A * | 2/1997 | Parker et al. | 438/692 |
| 5,984,764 | A * | 11/1999 | Saito et al. | 451/56 |
| 6,364,752 | B1 * | 4/2002 | Kimura et al. | 451/56 |
| 6,629,874 | B1 * | 10/2003 | Halley | 451/6 |
| 6,857,942 | B1 * | 2/2005 | Lin et al. | 451/56 |

(Continued)

FOREIGN PATENT DOCUMENTS

| | | |
|---|---|---|
| JP | 10-000550 | 1/1998 |
| JP | 2004-047876 | 2/2004 |
| JP | 2005-509531 | 4/2005 |
| JP | 2005-518285 | 6/2005 |
| WO | 02/102548 | 12/2002 |
| WO | 02/102549 | 12/2002 |

OTHER PUBLICATIONS

Horng (A Model to simulate surface roughness in the pad dressing process, Sep. 30, 2007.*

(Continued)

*Primary Examiner* — Kavita Padmanabhan
*Assistant Examiner* — Darrin Dunn
(74) *Attorney, Agent, or Firm* — Wenderoth, Lind & Ponack, L.L.P.

(57) ABSTRACT

A method dresses a polishing member with a diamond dresser having diamond particles arranged on a surface thereof. The method includes determining dressing conditions by performing a simulation of a distribution of a sliding distance of the diamond dresser on a surface of the polishing member, and dressing the polishing member with the diamond dresser under the determined dressing conditions. The simulation includes calculating the sliding distance corrected in accordance with a depth of the diamond particles thrusting into the polishing member.

12 Claims, 19 Drawing Sheets

(56) References Cited

U.S. PATENT DOCUMENTS

| | | | | |
|---|---|---|---|---|
| 6,905,400 | B2 * | 6/2005 | Kimura et al. | 451/86 |
| 2002/0072300 | A1 * | 6/2002 | Kimura et al. | 451/5 |
| 2004/0072512 | A1 * | 4/2004 | Kimura et al. | 451/56 |
| 2007/0084131 | A1 * | 4/2007 | Palmgren | 51/293 |
| 2007/0103279 | A1 * | 5/2007 | Hayashi et al. | 340/429 |
| 2007/0205112 | A1 * | 9/2007 | Kodera et al. | 205/641 |
| 2007/0208502 | A1 * | 9/2007 | Sakamoto et al. | 701/205 |
| 2008/0009231 | A1 * | 1/2008 | Stinson et al. | 451/443 |
| 2009/0191797 | A1 * | 7/2009 | Nabeya et al. | 451/54 |
| 2011/0003538 | A1 * | 1/2011 | Sung et al. | 451/56 |
| 2012/0071065 | A1 * | 3/2012 | Nabeya et al. | 451/67 |

OTHER PUBLICATIONS

Liao et al. (Applications of Taguchi and design of experiments methods in optimization of chemical mechanical polishing process parameters, Jul. 18, 2007).*

Liao et al. (Applications of Taguchi and design of experiment methods in optimization of chemical mechanical polishing parameters, 2007).*

Horng (Modeling and simulation of non-uniformity in the planarization process, 2007).*

* cited by examiner

DRESSING METHOD, METHOD OF DETERMINING DRESSING CONDITIONS, PROGRAM FOR DETERMINING DRESSING CONDITIONS, AND POLISHING APPARATUS

BACKGROUND OF THE INVENTION

1. Field of the Invention

The present invention relates to a method of dressing a polishing member, which is used in a polishing apparatus for polishing a workpiece (e.g., an optical parts, a mechanical parts, ceramics, and metal), by a diamond dresser and also relates to a method of determining dressing conditions, a program for determining dressing conditions, and a polishing apparatus. More particularly, the present invention relates to a dressing method, a method of determining dressing conditions, and a program for determining dressing conditions suitable for a polishing pad of a polishing apparatus that polishes a workpiece, such as a semiconductor wafer, to provide a planarized surface, and also relates to such a polishing apparatus.

2. Description of the Related Art

As a more highly integrated structure of a semiconductor device has recently been developed, interconnects of a circuit become finer and dimensions of the integrated device decrease. Thus, it becomes necessary to polish a semiconductor wafer having films (e.g., metal film) or layers on its surface to planarize the surface of the semiconductor wafer. One example of the planarization technique is a polishing procedure performed by a chemical-mechanical polishing (CMP) apparatus. This chemical-mechanical polishing apparatus includes a polishing member (e.g., a polishing cloth or polishing pad) and a holder (e.g., a top ring, polishing head, or chuck) for holding a workpiece, such as a semiconductor wafer to be polished. The polishing apparatus of this type is operable to press a surface (to be polished) of the workpiece against a surface of the polishing member and cause relative movement between the polishing member and the workpiece while supplying a polishing auxiliary (e.g., a polishing liquid, a chemical liquid, slurry, pure water) between the polishing member and the workpiece to thereby polish the surface of the workpiece to a flat finish. It is known that such a polishing process performed by the chemical-mechanical polishing apparatus yields a good polishing result due to a chemical polishing action and a mechanical polishing action.

Foam resin or nonwoven cloth is typically used as a material (raw material) of the polishing member used in such chemical-mechanical polishing apparatus. Fine irregularities (or asperity) are formed on the surface of the polishing member and these fine irregularities function as chip pockets that can effectively prevent clogging and can reduce polishing resistance. However, continuous polishing operations for the workpieces with use of the polishing member can crush the fine irregularities on the surface of the polishing member, thus causing a lowered polishing rate. Thus, a diamond dresser, having a number of diamond particles electrodeposited thereon, is used to dress (condition) the surface of the polishing member to regenerate fine irregularities on the surface of the polishing member.

Examples of the method of dressing the polishing member include a method using a dresser (a large-diameter dresser) that is equal to or larger than a polishing area used in polishing of the workpiece with the polishing member and a method using a dresser (a small-diameter dresser) that is smaller than the polishing area used in polishing of the workpiece with the polishing member. In the method of using the large-diameter dresser, a dressing operation is performed, for example, by pressing a dressing surface, on which the diamond particles are electrodeposited, against the rotating polishing member, while rotating the dresser in a fixed position. In the method of using the small-diameter dresser, a dressing operation is performed, for example, by pressing a dressing surface against the rotating polishing member, while moving the rotating dresser (e.g., reciprocation or swing motion in an arc or a linear vector). In both methods in which the polishing member is rotated during dressing, the polishing area on the surface of the polishing member for use in the actual polishing tends to be an annular area centered on a rotating axis of the polishing member.

During dressing of the polishing member, the surface of the polishing member is scraped off in a slight amount. Therefore, if dressing is not performed appropriately, unwanted undulation is formed on the surface of the polishing member, causing variation (or disorder) in a polishing rate within the polished surface of the workpiece when polishing. Such variation in the polishing rate can be a possible cause of polishing failure. Therefore, it is necessary to perform dressing of the polishing member without generating the undesired undulation on the surface of the polishing member. One approach to avoid the variation in the polishing rate is to perform the dressing operation under appropriate dressing conditions including an appropriate rotational speed of the polishing member, an appropriate rotational speed of the dresser, an appropriate dressing load, and an appropriate moving speed of the dresser (in the case of using the small-diameter dresser).

While the rotational speed of the polishing member, the rotational speed of the dresser, the dressing load, and the moving speed of the dresser can be controlled independently, these elements affect an amount of the polishing member to be scraped off in a complicated manner. In particular, in the dressing operation with use of the small-diameter dresser, determination of the dressing conditions from experiments requires a lot of time and labors. Thus, a method of determining the dressing conditions by simulation has been proposed. For example, Japanese laid-open patent publication No. 10-550 discloses a method of determining a distribution of a sliding distance of a dressing grinder to thereby optimize moving conditions of the dressing grinder. This method utilizes a fact that there is a close relationship between the sliding distance of the dressing grinder at each point on a polishing cloth and an amount of the polishing cloth that has been dressed (i.e., an amount of the polishing cloth scraped off by the dressing grinder).

However, the inventors found out the following. When comparing a simulation result of a distribution of a sliding distance of the diamond dresser and a measurement result of the amount of the polishing pad scraped by the diamond dresser, the simulation is not exactly accurate. FIG. 1 is a view illustrating an example of a movement range of a swinging small-diameter dresser 5 during dressing of a polishing pad 10 which is an example of the polishing member. A dresser arm 17 pivots on a dresser pivot axis O to thereby cause the dresser 5 to swing in a movement range indicated by an arc L. FIG. 2 is a graph showing a measurement result of the amount of the polishing pad scraped off under certain conditions by the small-diameter dresser as shown in FIG. 1 and a distribution of the sliding distances in a radial direction of the polishing pad obtained by a known method. The amount of polishing pad scraped off shown in FIG. 2 is expressed by normalized values which are given by dividing the measurement result of the amount of polishing pad scraped off by an average of the amount of polishing pad scraped off. The sliding distances shown in FIG. 2 are normalized values given by dividing the simulation result of the sliding distance by an average of the sliding distance.

From a quantitative comparison between the amount of the scraped polishing pad and the sliding distance, the followings can be seen. In a region from a center of the polishing pad (where a radius of the polishing pad is zero) to a radius of about 100 mm, both the amount of the scraped polishing pad and the sliding distance increase as the radius of the polishing pad increases. In a region where the radius of the polishing pad is around 120 mm, both the amount of the scraped polishing pad and the sliding distance decrease. In a region where the radius of the polishing pad is larger than 120 mm, both the amount of the scraped polishing pad and the sliding distance increase again. In a region where the radius of the polishing pad is around 250 mm, both the amount of the scraped polishing pad and the sliding distance decrease again. In a region where the radius of the polishing pad is larger than 250 mm, both the amount of the scraped polishing pad and the sliding distance increase again. Thus, there is no doubt that a close relationship exists between the amount of the polishing pad scraped off by the dresser and the sliding distance of the dresser. In this specification, the sliding distance means a travel distance of the dresser at each point on the polishing pad when the dresser and the polishing pad (polishing member) are moved relative to each other while keeping in contact with each other. Specifically, the sliding distance can be given by integrating a relative speed between the each point on the polishing pad and the dressing surface (i.e., the surface with the diamond particles arranged thereon) along a time axis. The aforementioned relative speed is a relative speed when the dressing surface is passing through each point on the polishing pad.

However, in the known method, the simulation result of the sliding distance undulates greatly as shown in FIG. 2, compared with the experimental result of the amount of the polishing pad that has been scraped off. In an accurate simulation of the amount of dressing (i.e., the amount of the polishing pad scraped off by the dressing operation) using the distribution of the sliding distance, the experimental result and the simulation result must be similar in distribution shape thereof. In other words, in FIG. 2, for example, the distribution shape of the amount of the scraped polishing pad and the distribution shape of the sliding distance must be similar to each other (or in a proportional relationship) with respect to the radial direction of the polishing pad. However, as described above, there is a great difference in the distribution shape between them. Therefore, if the known method is used to determine the dressing conditions for a desired amount of the polishing pad to be scraped off with use of the simulation result of the sliding distance, there will be a great difference between the amount of the polishing pad actually scraped off and the desired amount. As a result, further experimental studies are needed to find out dressing conditions that allow a desired distribution of the amount of the scraped polishing pad.

Further, in FIG. 2, the dressing conditions in the experiment and the simulation are such that part of the diamond dresser protrudes from a periphery of the polishing pad. In this case, a contact area between the dresser and the polishing pad decreases since part of the diamond dresser lies out of the polishing pad. As a result, while the dressing load of the diamond dresser (i.e., a load that presses the diamond dresser against the polishing pad) is constant, pressure of the diamond dresser on the polishing pad (i.e., dressing pressure) increases. As the dressing pressure increases, the amount of the scraped polishing pad is expected to increase approximately in proportion to the dressing pressure. In simulation of the sliding distance in FIG. 2, the increase in the dressing pressure is corrected by multiplying the sliding distance by a correction factor. However, as seen in FIG. 2, there is a great difference between the amount of the scraped polishing pad and the simulation result of the sliding distance at the periphery of the polishing pad where the diamond dresser protrudes from the polishing pad.

In a case where the polishing area for use in the polishing operation extends to almost the periphery of the polishing pad, it is necessary to appropriately dress the polishing pad including the periphery thereof. However, as described above, there exists the great difference between the amount of the polishing pad that has been actually removed and the simulation result of the sliding distance at the periphery of the polishing pad. Consequently, further efforts are needed to find out dressing conditions that allow a desired distribution of the amount of the scraped polishing pad for that purpose.

In addition, as the semiconductor device becomes smaller and the interconnects become finer, an acceptable range of the variation in the polishing rate decreases and it becomes important to appropriately control the distribution of the amount of the scraped polishing pad that affects the variation in the polishing rate. Therefore, it is necessary to determine the dressing conditions using a more accurate simulation.

SUMMARY OF THE INVENTION

The present invention has been made in view of the above drawbacks. It is therefore one object of the present invention to provide a method capable of dressing the polishing member in an amount close to an expected amount to be scraped by determining dressing conditions using a more accurate simulation than a conventional simulation. It is also one object of the present invention to provide a method of determining the dressing conditions, a program for determining the dressing conditions, and a polishing apparatus that can perform such a dressing method.

Inventors of the present invention have made intensive studies for achieving the aforementioned objects and have developed a method that can obtain more accurate simulation results than conventional simulation results by simulating the sliding distance in consideration of thrusting of diamonds, which are provided on a surface of the diamond dresser, into the polishing member, as will be discussed later. Further, the inventors have also found out a fact that, in a case where an angle between the diamond dresser and its rotational drive shaft is variable, the accuracy of simulation at the periphery of the polishing member can be improved by simulating the sliding distance in consideration of tilting of the diamond dresser when part of the diamond dresser protrudes from the periphery of the polishing member. The inventors have further found out a fact that dressing of the polishing member under the dressing conditions determined with use of the accurate simulation can result in a desired distribution of an amount of the polishing member that has been scraped off by the dressing operation.

One aspect of the present invention for achieving the above object is to provide a method of dressing a polishing member with a diamond dresser having diamond particles arranged on a surface thereof. The method includes: determining dressing conditions by performing a simulation of a distribution of a sliding distance of the diamond dresser on a surface of the polishing member; and dressing the polishing member with the diamond dresser under the dressing conditions determined. The simulation includes calculation of the sliding distance corrected in accordance with a depth of the diamond particles thrusting into the polishing pad.

Because the sliding distance is simulated in consideration of the thrusting of the diamond particles into the polishing member, a more accurate simulation result can be obtained. Therefore, by dressing the polishing member under the dressing conditions determined with use of the simulation, a desired distribution of the amount of the polishing member scraped off by the dressing operation can be realized.

In a preferred aspect of the present invention, the simulation includes calculation of the sliding distance further corrected in accordance with tilting of the diamond dresser when the diamond dresser protrudes from the polishing member.

According to the preferred aspect of the present invention, the accuracy of the simulation can be further improved at the periphery of the polishing member. Therefore, by dressing the polishing member under the dressing conditions determined with use of the simulation, a desired distribution of the amount of the polishing member scraped off by the dressing operation can be realized even at the periphery of the polishing member. In particular, the present invention is advantageous in the case where the dresser is tiltable with respect to a dresser rotational shaft.

In a preferred aspect of the present invention, the simulation includes calculation of the sliding distance in accordance with an acceleration of movement of the diamond dresser.

When the diamond dresser moves (e.g., swings) on the polishing member, the moving speed thereof is not always constant. For example, turnaround motion of the reciprocating dresser and changing of the moving speed entail acceleration. By reflecting the acceleration of the diamond dresser in the simulation, the accuracy of the simulation can be further improved. Therefore, by dressing the polishing member under the dressing conditions determined with use of the simulation, a desired distribution of the amount of the polishing member scraped off by the dressing operation can be realized.

Another aspect of the present invention is to provide a method of dressing a polishing member with a diamond dresser having diamond particles arranged on a surface thereof. The method includes: calculating a sliding distance of the diamond dresser on a surface of the polishing member using temporary dressing conditions; correcting the calculated sliding distance in accordance with a depth of the diamond particles thrusting into the polishing member; searching dressing conditions for a desired distribution of the sliding distance by modifying the temporary dressing conditions; and dressing the polishing member with the diamond dresser under the dressing conditions searched.

According to the present invention, the dressing conditions are searched by modifying elements (variables) constituting the dressing conditions such that the calculation result of the distribution of the sliding distance of the diamond dresser agrees with the desired distribution of the sliding distance. Further, the sliding distance is corrected in accordance with the depth of the diamond particles into the polishing member. Therefore, the calculation result of the distribution of the sliding distance is closer to an actual distribution of the amount of the polishing pad scraped off than a result of simple calculation of the distribution of the sliding distance. Further, by dressing the polishing member under the dressing conditions searched, the desired distribution or a distribution sufficiently close to the desired distribution of the amount of the polishing member scraped off by the dressing operation can be realized.

In a preferred aspect of the present invention, the method further includes correcting the corrected sliding distance in accordance with tilting of the diamond dresser when the diamond dresser protrudes from the polishing member.

With this method, the accuracy of the calculation at the periphery of the polishing member is further improved. Therefore, the desired distribution or a distribution sufficiently close to the desired distribution of the amount of the polishing member scraped off by the dressing operation can be realized even at the periphery of the polishing member.

In a preferred aspect of the present invention, the calculating the sliding distance of the diamond dresser comprises calculating the sliding distance of the diamond dresser in accordance with an acceleration of movement of the diamond dresser.

For example, in a case where the polishing member is rotated, the moving (e.g., swinging) speed of the diamond dresser may be changed in accordance with a radial position on the polishing pad. In this case, the acceleration of the diamond dresser is set to a finite value which is actually realizable for the diamond dresser, and the moving speed of the dresser according to the radial position on the polishing pad is determined, so that the sliding distance of the diamond dresser at each point on the polishing member is calculated, whereby a calculation result of the distribution of the sliding distance that is close to the actual distribution of the amount of the scraped polishing member can be obtained. In other words, for example, assuming that a first region and a second region are defined along the radial direction of the polishing member, the moving speed of the diamond dresser may differ between these two regions. In this case, instead of changing the moving speed of the diamond dresser discontinuously between these two regions, a transitional region having an appropriate dimension in the radial direction is defined between the first region and the second region and a finite acceleration (positive value or negative value) is set in this transitional region, so that the swinging speed is changed continuously from a value in one of the two regions to a value in the other. Therefore, in the transitional region defined near the boundary between the first region and the second region, the sliding distance is calculated in accordance with the preset acceleration. By dressing the polishing member under the dressing conditions that is searched in this manner, a distribution close to the desired distribution of the amount of the polishing member scraped off by the dressing operation can be realized.

Another aspect of the present invention is to provide a method of determining dressing conditions for use in dressing of a polishing member with a diamond dresser having diamond particles arranged on a surface thereof. The method includes: calculating a sliding distance of the diamond dresser on a surface of the polishing member using temporary dressing conditions; correcting the calculated sliding distance in accordance with a depth of the diamond particles thrusting into the polishing member; and searching dressing conditions for a desired distribution of the sliding distance by modifying the temporary dressing conditions.

According to the present invention, the dressing conditions are searched by modifying elements (variables) constituting the dressing conditions such that the calculation result of the distribution of the sliding distance of the diamond dresser agrees with the desired distribution of the sliding distance. Further, the sliding distance is corrected in accordance with the depth of the diamond particles thrusting into the polishing member. Consequently, the calculation result of the distribution of the sliding distance becomes closer to an actual distribution of the amount of the polishing pad scraped off than a result of simple calculation of the distribution of the sliding distance. Therefore, the method according to the present invention can search the dressing conditions that can realize the desired distribution or a distribution sufficiently close to the desired distribution of the amount of the polishing member scraped off by the dressing operation.

In a preferred aspect of the present invention, the method of determining dressing conditions further includes correcting the corrected sliding distance in accordance with tilting of the diamond dresser when the diamond dresser protrudes from the polishing member.

In a preferred aspect of the present invention, the calculating the sliding distance of the diamond dresser comprises calculating the sliding distance of the diamond dresser in accordance with an acceleration of movement of the diamond dresser.

Another aspect of the present invention is to provide a program for determining dressing conditions for use in dressing of a polishing member with a diamond dresser having diamond particles arranged on a surface thereof. The program causes a computer to execute: calculating of a sliding distance of the diamond dresser on a surface of the polishing member using temporary dressing conditions; correcting of the calculated sliding distance in accordance with a depth of the diamond particles thrusting into the polishing member; and searching of dressing conditions for a desired distribution of the sliding distance by modifying the temporary dressing conditions.

In a preferred aspect of the present invention, the program causes the computer to execute correcting of the corrected sliding distance in accordance with tilting of the diamond dresser when the diamond dresser protrudes from the polishing member.

In a preferred aspect of the present invention, the calculating of the sliding distance of the diamond dresser comprises calculating of the sliding distance of the diamond dresser in accordance with an acceleration of movement of the diamond dresser.

Another aspect of the present invention is to provide a computer-readable storage medium storing the program for determining the dressing conditions.

Another aspect of the present invention is to provide a polishing apparatus including: a relative-movement mechanism configured to bring a workpiece to be polished and a polishing member into sliding contact with each other; a dressing unit having a diamond dresser configured to dress the polishing member; and an arithmetic device configured to determine dressing conditions for realizing a desired distribution of an amount of the polishing member scraped off by the diamond dresser using a distribution of a sliding distance of the diamond dresser. The dressing unit is configured to dress the polishing member under the dressing conditions determined by the arithmetic device.

In a preferred aspect of the present invention, the diamond dresser has diamond particles arranged on a surface thereof, and the arithmetic device is configured to calculate the sliding distance corrected in accordance with a depth of the diamond particles thrusting into the polishing member.

In a preferred aspect of the present invention, the arithmetic device is configured to calculate the sliding distance further corrected in accordance with tilting of the diamond dresser when the diamond dresser protrudes from the polishing member.

In a preferred aspect of the present invention, the arithmetic device is configured to calculate the sliding distance in accordance with an acceleration of movement of the diamond dresser.

Another aspect of the present invention is to provide a method of operating a polishing apparatus having a polishing member for polishing a workpiece, the polishing apparatus including an arithmetic device and a diamond dresser having diamond particles arranged on a surface thereof. The method includes: a first operation process of determining dressing conditions by performing a simulation of a distribution of a sliding distance of the diamond dresser on a surface of the polishing member; and a second operation process of dressing the polishing member with the diamond dresser under the dressing conditions determined. The simulation includes calculation of the sliding distance corrected in accordance with a depth of the diamond particles thrusting into the polishing member.

According to the present invention, in dressing of the polishing member with the diamond dresser, the dressing conditions can be determined using the more accurate simulation than a conventional simulation. Therefore, dressing of the polishing member under the dressing conditions determined can provide a distribution close to a desired distribution of the amount of the polishing member scraped off.

DETAILED DESCRIPTION OF THE INVENTION

A dressing method using a small-diameter dresser according to an embodiment of the present invention will be described with reference to the drawings. This dressing method is suitable for dressing a polishing pad (polishing member) used in a polishing apparatus for polishing a workpiece, such as a semiconductor wafer.

Figure 1:
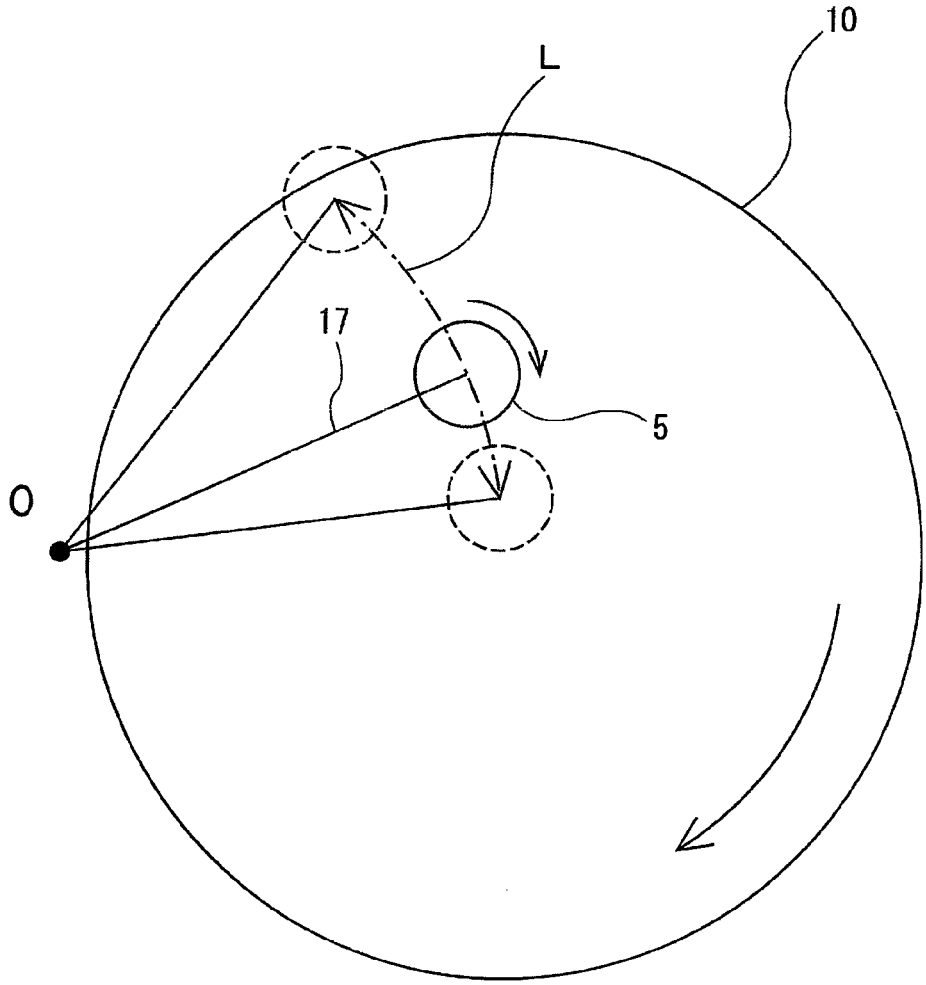
FIG. 1 is a view showing an example of a range of swinging movement of a small-diameter dresser when dressing a polishing pad.
Figure 3:
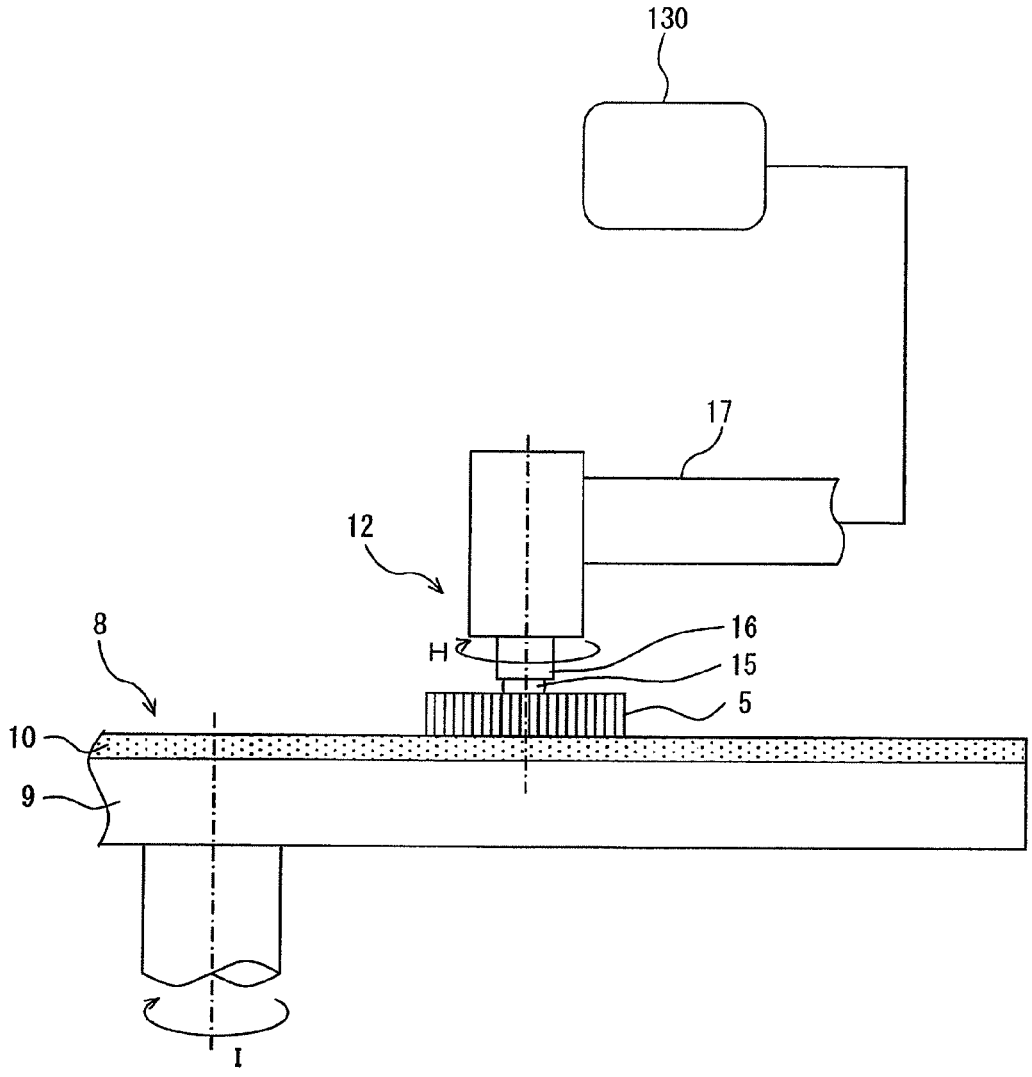
FIG. 3 is a schematic view showing a diamond dresser when dressing a polishing pad as viewed from a lateral direction.

FIG. 3 is a schematic view showing a diamond dresser 5 when dressing a polishing pad 10 as viewed from a lateral direction. As shown in FIG. 3, the diamond dresser 5 is coupled to a dresser rotational shaft 16 via a universal joint 15. The dresser rotational shaft 16 is coupled to a non-illustrated rotating device. The dresser rotational shaft 16 is rotatably supported by a dresser arm 17, and the dresser 5 is swung by the dresser arm 17 as shown in FIG. 1 while contacting the polishing pad 10. The universal joint 15 is configured to transmit rotation of the dresser rotational shaft 16 to the dresser 5 while allowing tilting motion of the dresser 5. The dresser 5, the universal joint 15, the dresser rotational shaft 16, the dresser arm 17, and the non-illustrated rotating device constitute a dressing unit 12. An arithmetic device 130 for determining a sliding distance of the dresser 5 by simulation is electrically connected to the dressing unit 12. A dedicated or general-purpose computer can be used as the arithmetic device 130.

A polishing table 8 includes a polishing platen 9 and a polishing pad 10 attached to an upper surface of the polishing platen 9. This polishing platen 9 is rotated by a rotating device (now shown in the drawing), so that the polishing pad 10 is rotated together with the polishing platen 9 in unison. A semiconductor wafer, which is a workpiece to be polished, is pressed by a top ring, which will be described later, against an upper surface (i.e., a polishing surface) of the polishing pad 10. In this state, the polishing pad 10 and the semiconductor wafer are moved relative to each other, whereby a surface of the semiconductor wafer is polished. In this embodiment, the polishing pad is used as typifying the polishing member. However, the polishing member is not limited to the polishing pad, and the present invention is applicable to other examples, such as a polishing cloth, as well.

Figure 4A:
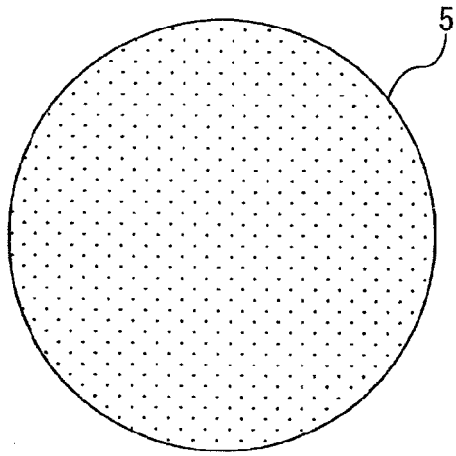
FIG. 4A through FIG. 4C are views each showing an example of a dressing surface.
Figure 4B:
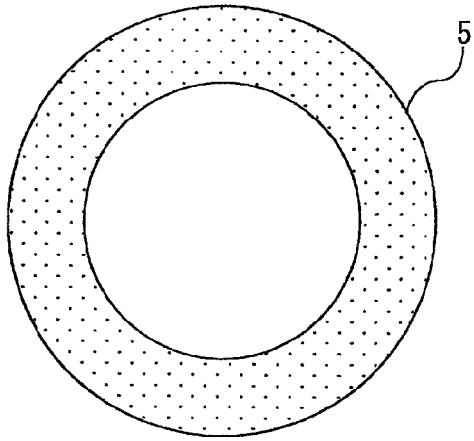
Figure 4C:
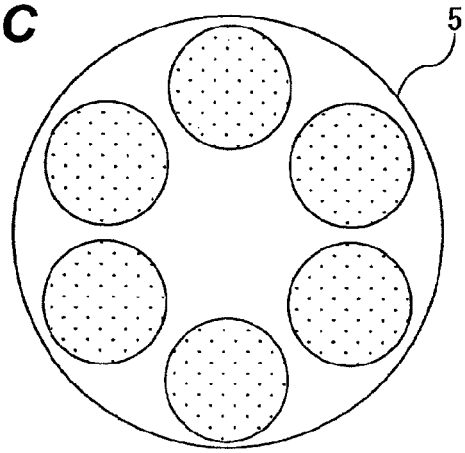

Diamond particles are secured to a lower surface of the dresser 5. This portion, to which the diamond particles are attached, constitutes a dressing surface that is used to dress the polishing surface of the polishing pad 10. FIG. 4A through FIG. 4C are views each showing an example of the dressing surface. In the example shown in FIG. 4A, the diamond particles are secured to the lower surface of the dresser 5 in its entirety to provide a circular dressing surface. In the example shown in FIG. 4B, the diamond particles are secured to a periphery of the lower surface of the dresser 5 to provide an annular dressing surface. In the example shown in FIG. 4C, the diamond particles are secured to surfaces of plural small-diameter pellets arranged around an axis of the dresser 5 at substantially equal intervals to provide plural circular dressing surfaces.

When dressing the polishing pad 10, as shown in FIG. 3, the polishing pad 10 is rotated by a rotating device (not shown in the drawing) at a predetermined rotational speed in a direction as indicated by arrow I, and the dresser 5 is also rotated by the non-illustrated rotating device at a predetermined rotational speed in a direction as indicated by arrow H. In this state, the dressing surface (i.e., the surface with the diamond particles provided thereon) of the dresser 5 is pressed against the polishing pad 10 at a predetermined dressing load to thereby dress the polishing pad 10. Further, the dresser arm 17 causes the dresser 5 to swing on the polishing pad 10 to thereby enable the dresser 5 to dress an area of the polishing pad 10 for use in a polishing process (i.e., a polishing area where the workpiece, such as a semiconductor wafer, is polished). It is noted that the rotating directions are not limited to those indicated by the arrows I and H.

Since the dresser 5 is coupled to the rotating device via the universal joint 15 and the dresser rotational shaft 16, even if the surface of the polishing pad 10 and the dresser rotational shaft 16 are inclined slightly with respect to each other, the dressing surface of the dresser 5 is kept in contact with the polishing pad 10 appropriately.

Next, swinging movement of the dresser 5 will be described with reference to FIG. 1. The dresser arm 17 pivots on a dresser pivot axis O. This pivoting movement of the dresser arm 17 causes a rotating center of the dresser 5 to swing in a range as indicated by the arc L.

Figure 5:
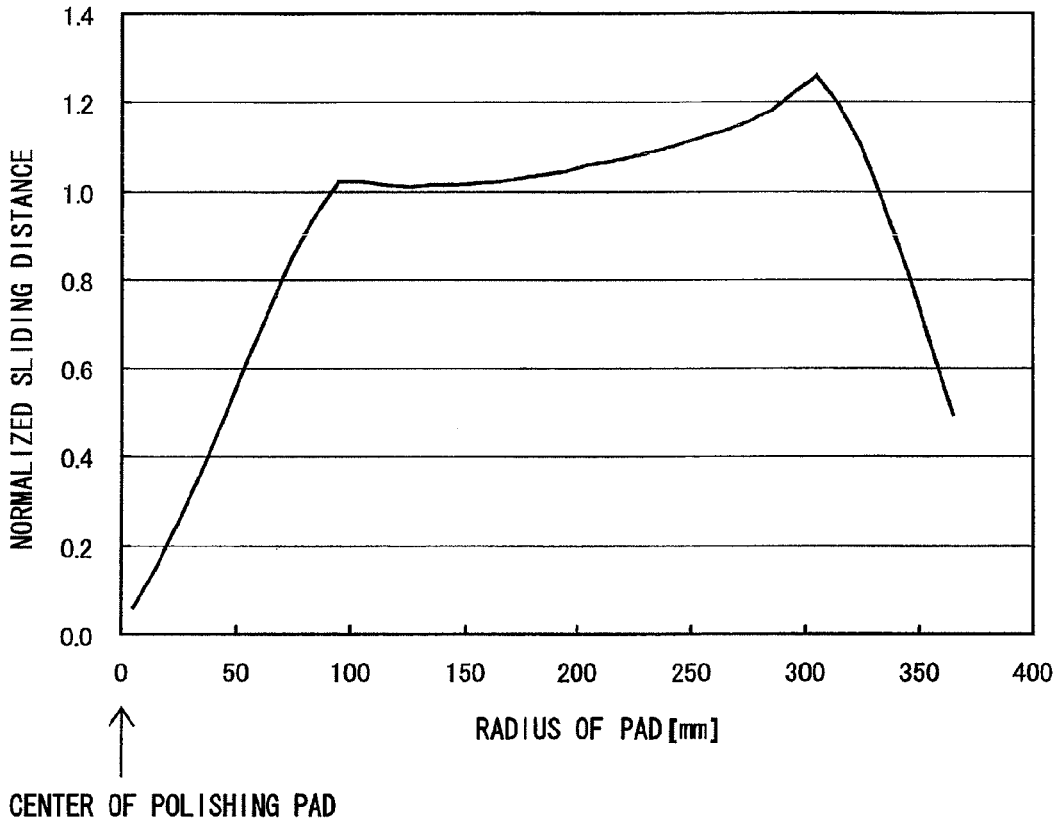
FIG. 5 is a graph showing a simulation result of a distribution of the sliding distance in a case where a swinging speed of the dresser is kept constant over the whole range of swinging movement of the dresser.

The dresser 5 may be a type of dresser having the diamond particles provided on the lower surface thereof in its entirety (i.e., the example shown in FIG. 4A). In this case, when a swinging speed of the dresser 5 is constant over the whole range of the arc L, a distribution of the sliding distance of the dresser 5 at each point on the polishing pad 10 is as shown in a graph of FIG. 5. The distribution of the sliding distance shown in FIG. 5 is the distribution of the sliding distance of the dresser with respect to a radial direction of the polishing pad (i.e., the polishing member). A term "normalized sliding distance" in FIG. 5 is a value given by dividing the sliding distance by an average of the sliding distances. Generally, if a distribution of an amount of the polishing pad scraped by the dresser is substantially uniform in a contact area of the polishing pad with the workpiece, the polishing surface of the polishing pad becomes flat. As a result, variation in polishing speed (i.e., unevenness of removal rate) within the surface of the semiconductor wafer to be polished is reduced. Because the distribution of the amount of the scraped polishing pad and the distribution of the sliding distance are considered to be in an approximately proportional relationship, in the case of the sliding-distance distribution as shown in FIG. 5, the variation in the polishing rate within the surface of the semiconductor wafer would increase, thus leading to an undesired consequence.

To avoid such drawbacks, the swinging speed of the dresser 5 may be changed according to locations on the arc L. For example, the arc L is divided into several swing segments and a swinging speed of the dresser 5 is determined for each swing segment as shown in table 1.

TABLE 1

| SWING SEGMENT | SWINGING SPEED |
|---|---|
| SWING SEGMENT 1 | SWINGING SPEED 1 |
| SWING SEGMENT 2 | SWINGING SPEED 2 |
| SWING SEGMENT 3 | SWINGING SPEED 3 |
| SWING SEGMENT 4 | SWINGING SPEED 4 |
| SWING SEGMENT 5 | SWINGING SPEED 5 |
| SWING SEGMENT 6 | SWINGING SPEED 6 |
| SWING SEGMENT 7 | SWINGING SPEED 7 |
| SWING SEGMENT 8 | SWINGING SPEED 8 |

In this specification, a combination of the rotational speed of the polishing pad 10 during dressing, the rotational speed of the dresser 5 during dressing, the dressing load, the swing segments of the dresser 5, and the swinging speed of the dresser 5 is referred to as dressing conditions (or a dressing recipe). It is noted that a dressing time, the swing range (i.e., a length of the arc L), and a swing radius (i.e., a distance from the dresser pivot axis O to the arc L) may be included in the dressing conditions. The above-described "swing segments" mean a plurality of segments defined by dividing the "swing range (i.e., the length of the arc L)" in the radial direction of the polishing pad 10. As discussed above, determination of the dressing conditions from experiments requires a lot of time and labor. The method according to the embodiment of the present invention utilizes the fact that there is a close relationship between the sliding distance of the dresser 5 at each point on the polishing surface of the polishing pad 10 and the amount of the polishing pad 10 scraped off by the dresser 5, and calculates the sliding-distance distribution of the dresser 5 and can determine the dressing conditions.

The sliding distance of the dresser will be described herein. The sliding distance of the dresser is a travel distance of the dressing surface (i.e., an area where the diamond particles are attached) that slides over a certain point on the surface (polishing surface) of the polishing pad. For example, in a case where both the polishing pad 10 and the dresser 5 are not rotated and the dresser 5 moves linearly, when the dresser with the diamond particles arranged on the entire lower surface thereof as shown in FIG. 4A moves such that the center of the dresser travels through a certain point on the polishing pad 10, the sliding distance of the dresser at that point is equal to the diameter of the dresser. When the dresser with the diamond particles arranged in a ring shape as shown in FIG. 4B moves such that the center of the dresser travels through a certain point on the polishing pad 10, the sliding distance of the dresser at that point is twice the width of the ring. This means that the sliding distance at a certain point on the polishing pad 10 is expressed as the product of the moving speed of the dresser at that point and a transit time (i.e., a contact time) of the area where the diamond particles are attached (i.e., the dressing surface).

In a case where both the polishing pad 10 and the dresser 5 are rotated and the dresser 5 moves, the sliding distance at a certain point on the polishing pad 10 is given by integrating the relative speed between the dresser 5 and the polishing pad 10 at that point along a time axis ranging from a dressing start point to a dressing end point.

As described above, it is not possible to accurately estimate the distribution of the amount of the scraped polishing pad by simply simulating the sliding-distance distribution of the dresser. Therefore, it is difficult for the dressing operation under the dressing conditions determined by the simulation of only the sliding-distance distribution to dress the polishing pad to provide a desired distribution of the amount of the polishing pad scraped.

Thus, the present invention provides a method capable of dressing the polishing pad in an amount close to a desired amount to be scraped by determining the dressing conditions using a more accurate simulation than a conventional simulation. The simulation method according to the embodiment of the present invention will be described below.

As described above, there is a close relationship between the amount of the polishing pad scraped and the sliding distance of the dresser. However, the difference between the distribution of the amount of the scraped polishing pad and the distribution of the sliding distance is large. Thus, the distribution of the sliding distance is corrected in accordance with thrusting of the diamond particles of the diamond dresser into the polishing pad (i.e., a depth of the diamond particles thrusting (or cutting) into polishing pad). An example of the simulation method for the distribution of the sliding distance will be described with reference to a flowchart shown in FIG. 6. In this simulation method, an increment of the sliding distance during the passage of a small period of time from a certain time is calculated as the product of the relative speed at each point on the polishing pad at that time and the small period of time, and the sliding distance is determined by integrating the increment of the sliding distance from a dressing start time to a dressing end time.

In this embodiment, the arithmetic device 130 (see FIG. 3) is provided. This arithmetic device 130 is configured to read data, such as apparatus parameters and the dressing conditions, which are necessary for the simulation of the distribution of the sliding distance. These data may be described directly in a program stored in a computer-readable storage medium, such as a hard disk drive, or may be inputted from an input device, such as a keyboard. Alternatively, the arithmetic device 130 may read the data from a control computer of the polishing apparatus. In FIG. 3, the arithmetic device 130 is electrically connected to the dressing unit 12. However, the present invention is not limited to this embodiment. For example, the arithmetic device 130 may be installed independently with no direct communication with the dressing unit 12 via electrical signals. In this case, the arithmetic device (i.e., calculator) performs a simulation process for searching the dressing conditions, and the dressing conditions created by the arithmetic device are inputted into a controller (not shown in the drawing) for controlling operations of the polishing apparatus, so that the dressing operation is performed.

The apparatus parameters include data on the range of the diamond particles arranged on the dresser 5, data on a position of the dresser pivot axis, the radius of the swinging movement of the dresser 5, the diameter of the polishing pad 10, accelerations of the swinging movement of the dresser 5, and the like.

The data on the range of the diamond particles arranged on the dresser 5 are data including a shape and a size of the dressing surface. For example, in the case of using the dresser with the diamond particles arranged on the lower surface of the dresser in its entirety as shown in FIG. 4A, the data include an outer diameter of the dresser. In the case of using the dressier with the diamond particles arranged in a ring shape as shown in FIG. 4B, the data include an outer diameter and an inner diameter of the ring formed by the diamond particles. In the case of using dresser with the diamond particles arranged on plural small-diameter pellets as shown in FIG. 4C, the data include positions of centers of the respective pellets and diameters of the respective pellets where the diamond particles are attached.

The dressing conditions include the rotational speed of the polishing pad 10, a starting position of the swinging movement of the dresser 5, the range of the swinging movement of the dresser 5, the number of swing segments, widths of the respective swing segments, the swinging speeds of the dresser 5 at the respective swing segments, the rotational speed of the dresser 5, the dressing load, and the dressing time.

The arithmetic device 130 also reads the number of dressing operations to be repeated (i.e., the preset repetition number), together with the apparatus parameters and the dressing conditions. This is because, if the distribution of the sliding distance is determined by the simulation based on one dressing operation that is performed in a certain preset period of time, the distribution of the sliding distance obtained may differ greatly from the distribution of the amount of the polishing pad that has been scraped off by the dressing operation. For example, when the number of reciprocations (swinging movements) of the dresser per one dressing operation is small, the difference between the amount of the scraped polishing pad and the distribution of the sliding distance of the dresser may be large.

Figure 7:
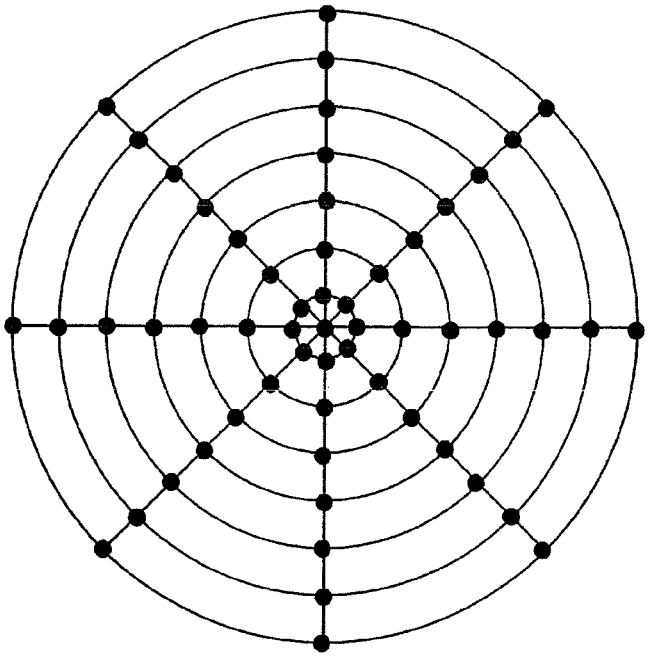
FIG. 7 is a view showing an example of sliding-distance calculation points.

Next, coordinates of sliding-distance calculation points on the surface (i.e., the polishing surface) of the polishing pad 10 are set. For example, a cylindrical coordinate system with its origin located on the rotating axis of the polishing pad 10 is defined on the polishing surface of the polishing pad 10, and intersections of a grid that divides the polishing surface in the radial direction and the circumferential direction are set to the sliding-distance calculation points. FIG. 7. shows an example of the sliding-distance calculation points. In FIG. 7, intersections of concentric circles and radially-extending lines are defined as the sliding-distance calculation points. In order to improve a computing speed, the number of zones to be divided may be reduced. It is not indispensable to divide the polishing surface in the circumferential direction. It is noted that rectangular coordinate system may be defined instead of the cylindrical coordinate system.

Next, initial values of variables, such as a time and the sliding distance at each sliding-distance calculation point, are set. These variables vary in accordance with calculation of the sliding distance.

Next, a time increment (i.e., the small period of time) $\Delta T$ is determined using intervals between the sliding-distance calculation points, the rotational speed of the polishing pad, the rotational speed of the dresser, the swinging speed of the dresser, and the like.

Next, the arithmetic device 130 judges the contact between the sliding-distance calculation point and the dresser based on the coordinates of the sliding-distance calculation point and positional information on the dressing surface of the dresser at a certain time.

Next, the arithmetic device 130 calculates a relative speed Vrel between the dresser and the polishing pad at the sliding-distance calculation point. Specifically, the arithmetic device 130 calculates the relative speed Vrel by determining a magnitude of a difference between a velocity vector of the dresser and a velocity vector of the polishing pad at each sliding-distance calculation point at a certain time. The velocity vector of the dresser is the sum of a velocity vector due to the rotation of the dresser and a velocity vector due to the swinging movement of the dresser. The velocity vector of the polishing pad is a velocity vector due to the rotation of the polishing pad.

Next, the arithmetic device 130 calculates a dresser-contact-area ratio S. The dresser-contact-area ratio is a value given by dividing an area of the dressing surface in its entirety (which is a constant value) by an area of a portion of the dressing surface contacting the polishing pad (which is a variable value). Where the polishing pad is dressed at a constant dressing load, when part of the dresser protrudes from the periphery of the polishing pad, contact surface pressure (i.e., dressing pressure) between the dresser and the polishing pad increases by that much. Since the amount of the polishing pad to be scraped off is considered to be approximately proportional to the contact surface pressure, an increase in the contact surface pressure will result in an increase in the amount of the scraped polishing pad. Therefore, in the calculation of the sliding distance, it is necessary to correct the sliding distance in proportion to the increase in the contact surface pressure. The dresser-contact-area ratio S is used in this correction. On the other hand, in a case where the dressing load is not constant and the dressing operation is performed at a constant dressing pressure, it is not necessary to correct the sliding distance. Therefore, in this case, it is not necessary to calculate the dresser-contact-area ratio. In this embodiment of the present invention, while its basic concept relies on the principle in which the amount of the scraped polishing member is approximately proportional to the sliding distance itself, the sliding distance is corrected in accordance with a change in the contact surface pressure that affects the amount of the scraped polishing member. In other words, the change in the contact surface pressure is replaced with the sliding distance. This correction can achieve an improvement of an accuracy of the proportional relationship between the amount of the polishing member scraped and the sliding distance (i.e., a consistency of the proportional relationship between them).

Next, the arithmetic device 130 calculates an increment $\Delta D_0$ of the sliding distance during the passage of the small period of time from a certain time. The $\Delta D_0$ is the product of the relative speed Vrel and the time increment $\Delta T$.

$$\Delta D_0 = V\text{rel} \times \Delta T \tag{1}$$

When a certain sliding-distance calculation point is judged to be out of contact with the dresser by the judgment of the contact between the sliding-distance calculation point and the dresser, the increment of the sliding distance at that sliding-distance calculation point is zero.

Next, the arithmetic device 130 corrects the increment $\Delta D_0$ of the sliding distance with use of the dresser-contact-area ratio S as follows.

$$\Delta D_1 = \Delta D_0 \times S \tag{2}$$

When the dressing operation is performed at constant dressing pressure, it is not necessary to correct the sliding distance. Therefore, in this case, $\Delta D_1$ is equal to $\Delta D_0$.

Figure 8:
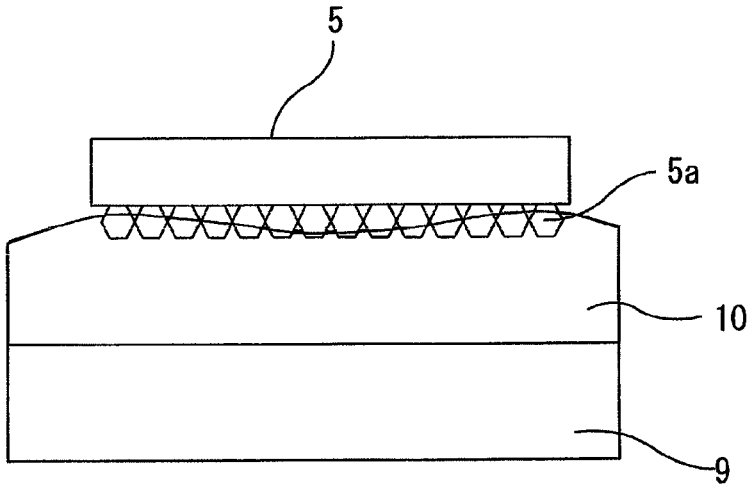
FIG. 8 is a view showing a depth of the diamond particles thrusting into the polishing member which varies depending on an undulation of a surface of the polishing member.

Next, the arithmetic device 130 corrects the corrected increment $\Delta D_1$ of the sliding distance according to an amount of the diamond particles thrusting into the polishing pad. If the sliding distance varies from zone to zone on the polishing surface, a zone with a short sliding distance is scraped off in a small amount and therefore a thickness of the polishing pad at that zone is relatively large. On the other hand, a zone with a long sliding distance is scraped off in a large amount and therefore the thickness of the polishing pad at that zone is relatively small. As a result, the polishing surface of the polishing pad undulates. As shown in FIG. 8, if the undulation is formed on the polishing surface of the polishing pad, the diamond particles 5*a* cut into the polishing pad 10 deeply at the relatively thick zone. On the other hand, at the relatively thin zone, the diamond particles 5*a* do not cut into the polishing pad 10 deeply. Thus, the arithmetic device 130 corrects the sliding distance so as to increase the sliding distance at a zone where the sliding distance is short and decrease the sliding distance at a zone where the sliding distance is long.

The above description can be simplified as follows. In the zone where the sliding distance is long, the polishing pad becomes thin. As a result, the diamond particles do not thrust into the polishing pad deeply, and the amount of the scraped polishing pad is small. Therefore, the sliding distance is corrected so as to decrease the sliding distance at the zone where the sliding distance is long. On the other hand, in the zone where the sliding distance is short, the polishing pad becomes thick. As a result, the diamond particles thrust into the polishing pad deeply, and the amount of the scraped polishing pad is large. Therefore, the sliding distance is corrected so as to increase the sliding distance at the zone where the sliding distance is short.

Figure 9:
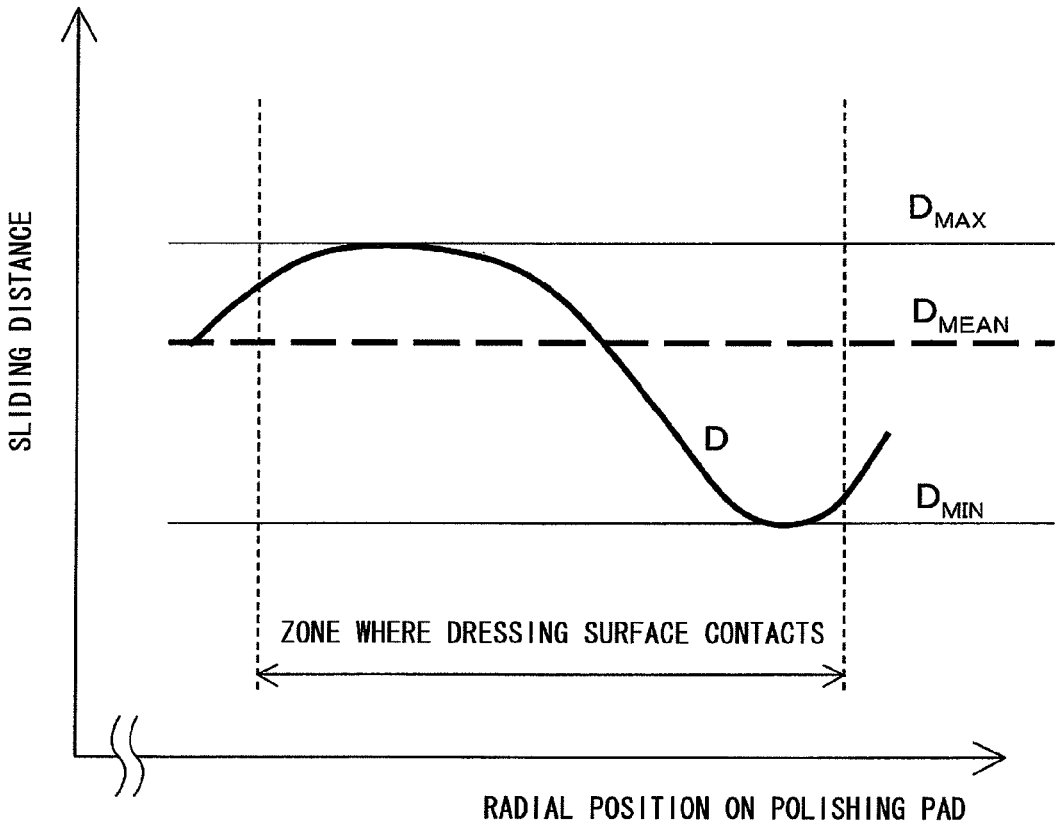
FIG. 9 is a graph illustrating an example of a correction procedure that rejects the thrusting of the diamond particles into the polishing pad.

An example of the method of correcting the increment $\Delta D_1$ of the sliding distance in view of the thrusting of the diamond particles into the polishing pad will be described with reference to FIG. 9. FIG. 9 is a graph showing the distribution of the sliding distance around a contact zone where the dressing surface contacts the polishing pad at a certain time. The graph in FIG. 9 is expressed as a two-dimensional graph for easy comprehension. In FIG. 9, a region interposed between thin dotted lines is a zone where the dressing surface contacts the polishing pad, a thick solid line represents the sliding distance (D) of the dresser, and a thick dotted line represents an average ($D_{MEAN}$) of the sliding distance in the zone where the dressing surface contacts the polishing pad. $D_{MAX}$ and $D_{MIN}$ represent a maximum and a minimum of the sliding distance at the contact zone of the dressing surface. The depth of the diamond particles thrusting into the polishing pad shows an opposite trend of the sliding distance (D) of the dresser. Specifically, when the former is large, the latter is small. On the other hand, when the former is small, the latter is large. Therefore, the depth of the diamond particles thrusting into the polishing pad can be expressed by using the sliding distance (D) of the dresser.

A correction factor $K_1$ for correcting the increment $\Delta D_1$ of the sliding distance in view of the manner of the diamond particles thrusting into the polishing pad is defined by the following equation.

$$K_1 = 1 - \alpha \frac{D - D_{MEAN}}{D_{MAX} - D_{MIN}} \quad (3)$$

The value $\alpha$ may be a constant or a function of a value "$D_{MAX}-D_{MIN}$" (e.g., a value proportional to the value "$D_{MAX}-D_{MIN}$"). Then, the increment $\Delta D_1$ of the sliding distance is corrected as follows.

$$\Delta D_2 = \Delta D_1 \times K_1 \quad (4)$$

In this manner, in the embodiment of the present invention, the sliding distance is corrected in accordance with the depth of the diamond particles thrusting (cutting) into the polishing pad. In other words, the depth of the diamond particles thrusting into the polishing pad is replaced with the sliding distance. This correction can achieve an improvement of an accuracy of the proportional relationship between the amount of the scraped polishing member and the sliding distance (i.e., a consistency of the proportional relationship between them). A minimum of the correction factor $K_1$ is set to zero, so that the corrected increment $\Delta D_2$ of the sliding distance does not take a negative value.

Figure 10:
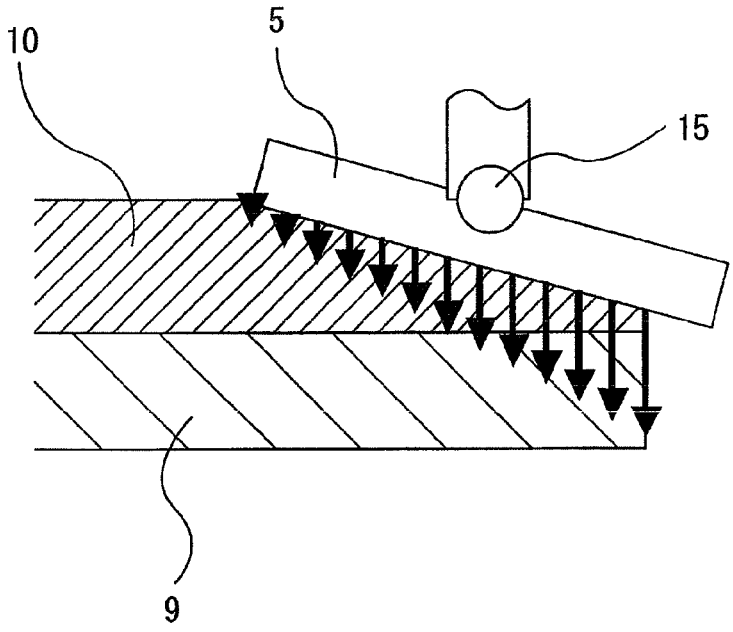
FIG. 10 is a view showing tilting of the dresser when protruding from the polishing member.

Next, the corrected increment $\Delta D_2$ of the sliding distance is further corrected in accordance with the tilting of the dresser 5 when the dresser 5 protrudes from the polishing pad 10. As described above, the dresser 5 is coupled to the dresser rotational shaft 16 via the universal joint 15 that allows the dressing surface to tilt with respect to the polishing surface of the polishing pad 10. Therefore, when the dresser 5 protrudes from the polishing pad 10, as shown in FIG. 10, the dresser 5 tilts so that moments, which are generated by reaction forces from the polishing pad 10, are balanced on the universal joint 15 (in FIG. 10, the tilting of the dresser 5 is exaggerated for explanation). When the dresser 5 does not protrude from the polishing pad 10, the distribution of the contact pressure (dressing pressure) between the polishing pad 10 and the dresser 5 is approximately uniform. However, when the dresser 5 protrudes from the polishing pad 10, the distribution of the dressing pressure does not become uniform, and the dressing pressure increases toward the periphery of the polishing pad 10.

Figure 11A:
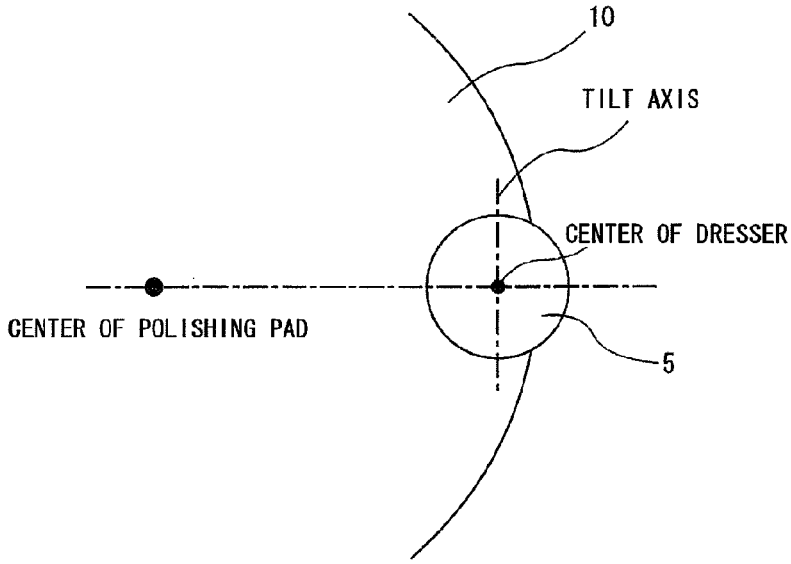
FIG. 11A is a plan view showing the dresser when dressing the polishing pad, with a periphery of the dresser protruding from the polishing pad.
Figure 11B:
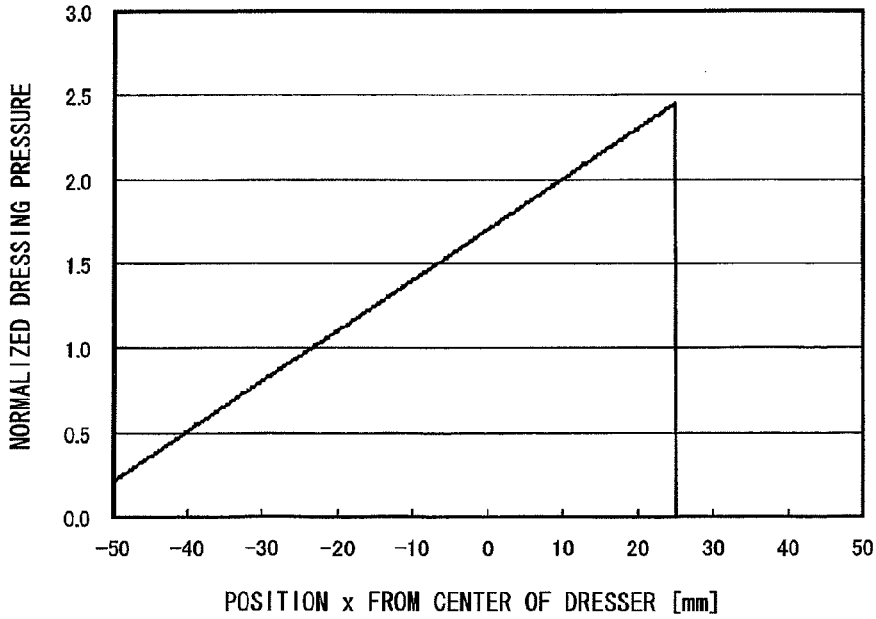
FIG. 11B is a graph showing a distribution of the dressing pressure on a straight line passing through the center of the polishing pad and the center of the dresser.

FIG. 11A is a plan view showing the dresser having a diameter of 100 mm when dressing the polishing pad having a diameter of 740 mm, with the periphery of the dresser protruding from the polishing pad by a maximum of 25 mm. FIG. 11B is a graph showing the distribution of the dressing pressure on a straight line passing through the center of the polishing pad and the center of the dresser. In the example as shown in FIG. 11A, the aforementioned dresser with the diamond particles secured to the entire lower surface thereof is used (see FIG. 4A). FIG. 11B shows the distribution of the dressing pressure determined by the balance between the dressing load and the reaction force from the polishing pad and the balance of the moments about the universal joint which are generated by the reaction force from the polishing pad. The dressing load is a force applied to the dresser via the dresser rotational shaft to press the dresser against the polishing pad. In FIG. 11B, a vertical axis represents a normalized dressing pressure given by a normalization process in which a dressing pressure when the dresser does not protrude from the polishing pad is defined as 1. Specifically, the normalized dressing pressure is a value given by dividing pressure at a position away from the center of the dresser by a distance of x mm by pressure applied to the polishing pad with the entire dressing surface contacting the polishing pad. A horizontal axis represents a position from the center of the dresser. The position of the center of the dresser is expressed as zero, and positions closer to the center of the polishing pad are expressed by negative values.

Figure 12A:
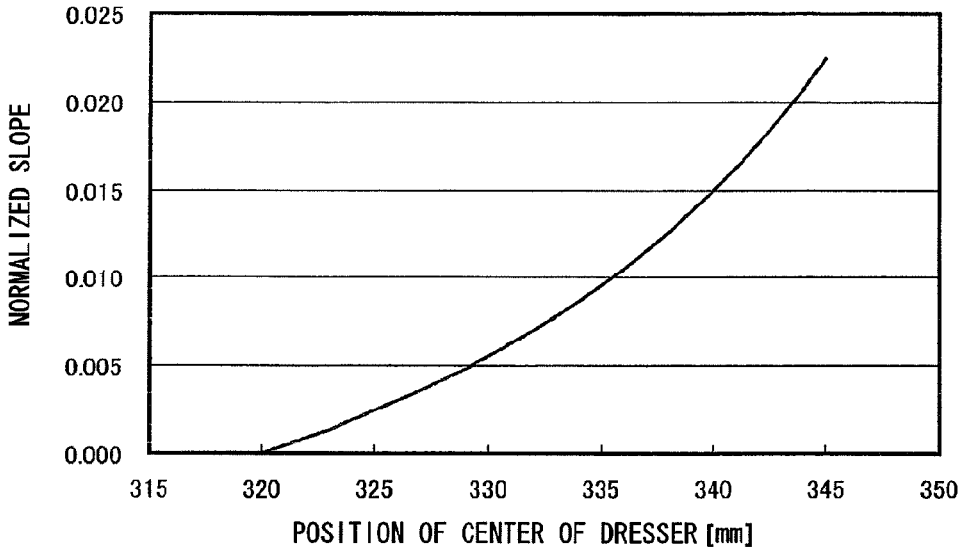
FIG. 12A is a graph showing a slope (normalized slope) of a distribution of the dressing pressure when the dresser is protruding from the polishing member.
Figure 12B:
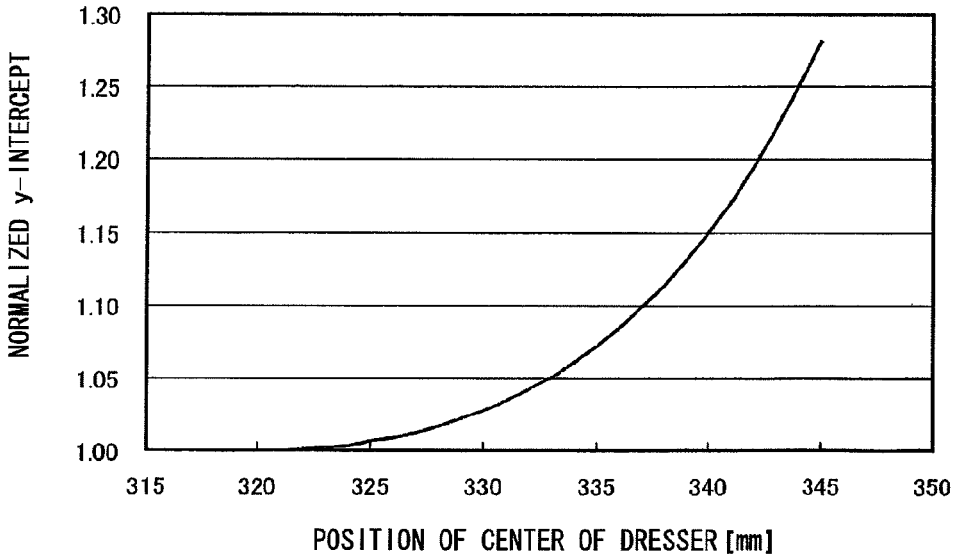
FIG. 12B is a graph showing normalized y-intercept.

As can be seen from FIG. 11A and FIG. 11B, when the dresser 5 is protruding from the polishing pad 10, the dressing pressure can be expressed roughly by a linear function using the position from the center of the dresser (i.e., a distance from a tilt axis shown in FIG. 11A and a negative value at the polishing-pad-center side: x). Further, as shown in FIG. 12A, a slope (i.e., a normalized slope: $f_\Delta$) of this linear function is determined uniquely with respect to a distance (a dresser central position: $C_0$) between the center of the polishing pad and the center of the dresser. The normalized slope is given by putting two imaginary points on a straight line of the linear function shown in FIG. 11B and dividing a difference in the normalized dressing pressure between the two points by a difference in the position from the center of the dresser between the two points. Further, a value of the dressing pressure at the center of the dresser is determined uniquely with respect to the distance (the dresser central position: $C_0$) between the center of the polishing pad and the center of the dresser. FIG. 12B shows an example of it. FIG. 12B does not show a value of the normalized dressing pressure itself at the center of the dresser and shows normalized y-intercept ($f_{y0}$), which is given by dividing the normalized dressing pressure at the center of the dresser by the normalized dressing pressure at a position where the dressing pressure takes an average thereof. In the example shown in FIG. 11B, the normalized dressing pressure takes an average at a position where the distance from the center of the dresser is −12.5 mm. Therefore, the normalized dressing pressure at a certain point on the dressing surface at a certain dresser central position $C_0$ can be calculated from the normalized slope and the normalized y-intercept of the dressing pressure at the dresser central position $C_0$ and the distance of said certain point from the tilt axis of the dresser (the distance from the center of the dresser). Therefore, a correction factor $K_2$ with respect to the tilting of the dresser is defined as follows.

$$K_2=f_\Delta(C_0)\times x+f_{y0}(C_0) \quad (5)$$

The increment $\Delta D_2$ of the sliding distance is corrected as follows.

$$\Delta D_3=\Delta D_2\times K_2 \quad (6)$$

In this manner, in the embodiment of the present invention, the sliding distance is further corrected in accordance with the tilting of the dresser. In other words, the tilting of the dresser is replaced with the sliding distance. This correction can achieve an improvement of an accuracy of the proportional relationship between the amount of the scraped polishing member and the sliding distance (i.e., a consistency of the proportional relationship between them).

The increment $\Delta D_3$ of the sliding distance is a result of performing corrections expressed by the above-described equations (2), (4), and (6) on the increment $\Delta D_0$ of the sliding distance during the small period of time. This increment $\Delta D_3$ of the sliding distance is added to a sliding distance at that time to thereby produce a new sliding distance. At this step, because the amount of the scraped polishing pad is considered to be approximately proportional to the dressing load and the dressing pressure, the increment $\Delta D_3$ of the sliding distance may be further corrected in accordance with the preset dressing load and dressing pressure.

Next, the arithmetic device 130 prepares for calculation of an increment of the sliding distance in a subsequent time increment (the small period of time). Specifically, the arithmetic device 130 virtually rotates the polishing member to move the slide-distance calculation point and virtually swings the dresser to move the dresser. Further, the arithmetic device 130 renews a time (i.e., adds the time increment to a time). In the movement of the dresser, it is preferable to calculate a position of the dresser at the next time increment in consideration of the acceleration of the dresser at a turn-around point of the dresser and a point between the swing segments (see table 1). That is, in order to accurately simulate the sliding distance of the dresser 5 at each point on the polishing pad 10, it is not enough to perform the corrections, expressed by the equations (2), (4), and (6), on the increment of the sliding distance calculated from the relative speed and the time increment. The swinging dresser turns around at both ends (i.e., a pad-center-side end and a pad-periphery-side end) of its movement path on the polishing pad 10. Therefore, the swinging speed increases and decreases (i.e., a positive acceleration or negative acceleration), and the sliding distance of the dresser 5 per unit time varies. Further, when the dresser 5 moves across each point between the swing segments (see table 1), the swinging speed increases or decreases at the boundaries between the swing segments and their neighboring regions as well. Therefore, the sliding distance of the dresser 5 per unit time varies. Thus, in order to accurately calculate the sliding distance itself at each point on the polishing pad 10, it is preferable for the simulation to reflect the acceleration of the movement of the dresser 5. By reflecting the acceleration of the dresser 5, a more accurate sliding distance can be obtained.

When the time reaches the dressing time, the arithmetic device 130 initializes the time, and repeats the calculation of the sliding distance for the dressing time until the preset repetition number (i.e., the number of dressing operations to be repeated) is reached. After the calculation of the sliding distance for the dressing time is repeated until the preset repetition number is reached, the arithmetic device 130 displays a result of the calculation, and performs ending processes, such as storing of the calculation result. Since the sliding distance is approximately proportional to the amount of the scraped polishing member, the calculated sliding distance may be multiplied by a conversion factor (a proportional constant) to obtain a calculation result of the amount of the polishing member to be scraped.

Figure 6:
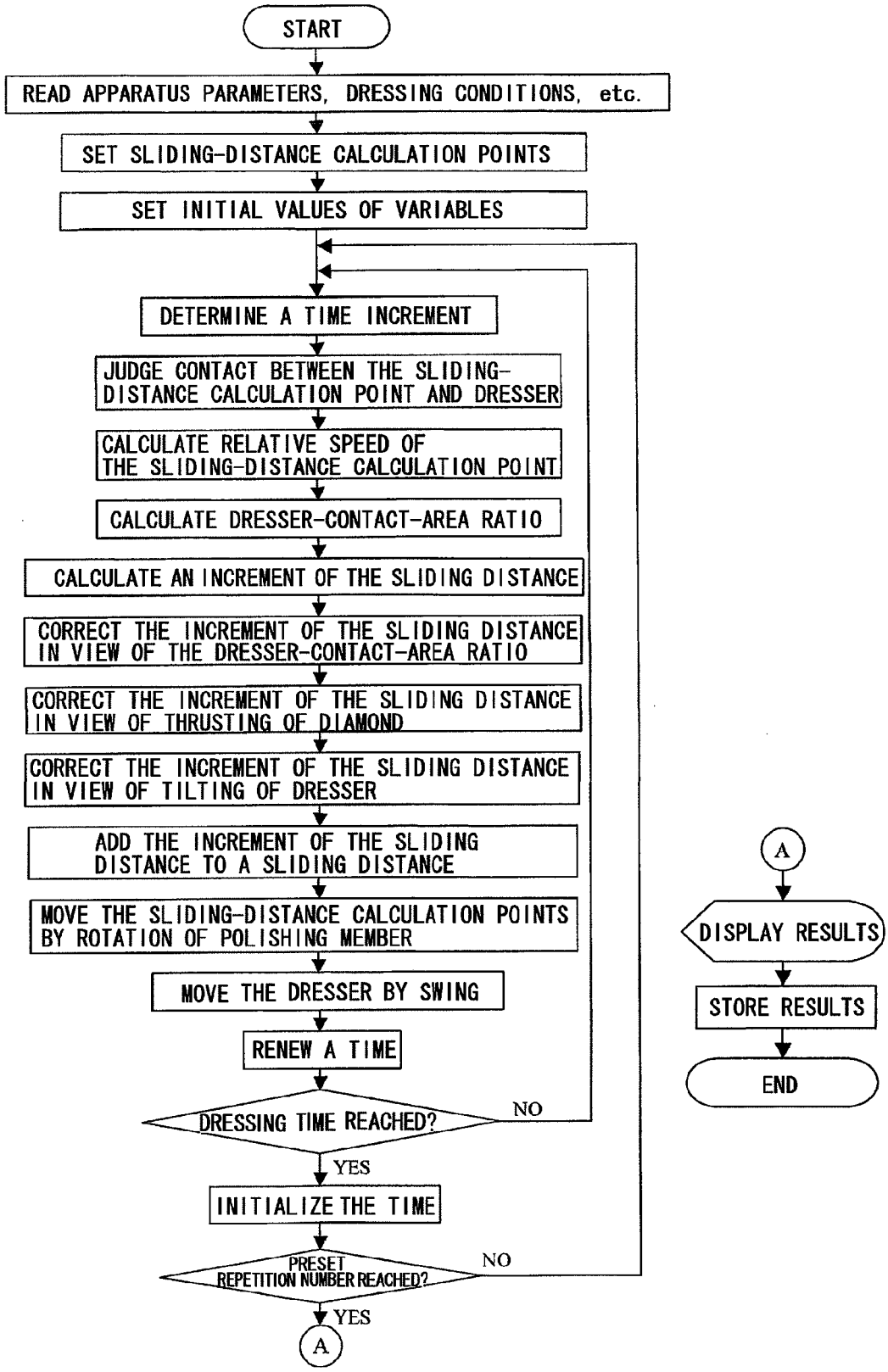
FIG. 6 is a flowchart of a simulation for the distribution of the sliding distance in consideration of thrusting of diamond particles into the polishing member.

In the aforementioned description with reference to FIG. 6, the correction steps are performed in the order of the calculation of the simple increment $\Delta D_0$ of the sliding distance, the correction of the increment of the sliding distance based on the dresser-contact-area ratio, the correction of the increment of the sliding distance based on the thrusting of the diamond particles into the polishing pad, and the correction of the increment of the sliding distance based on the tilting of the dresser. The final increment $\Delta D_3$ of the sliding distance is expressed from the equations (2), (4), and (6) as follows.

$$\Delta D_3=\Delta D_0\times S\times K_1\times K_2 \quad (7)$$

As can be seen from the above equation (7), the increment $\Delta D_3$ of the sliding distance does not depend on the order of the corrections.

Figure 2:
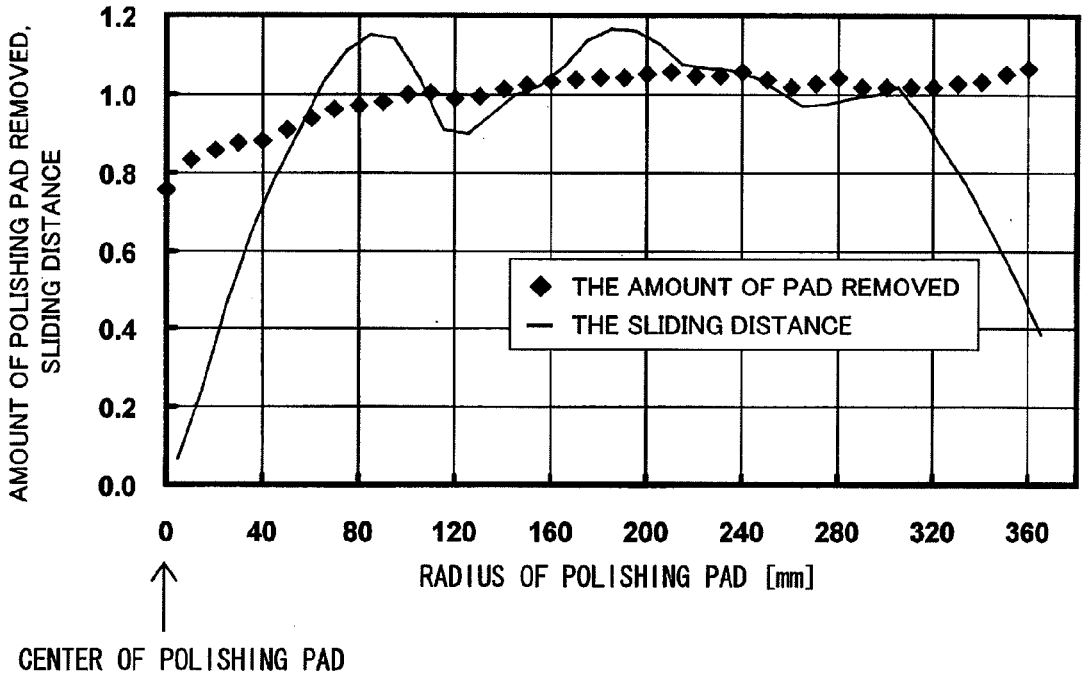
FIG. 2 is a graph showing a comparison between a measurement result of a distribution of an amount of the scraped polishing pad and a simulation result of a distribution of a sliding distance obtained by a known method.
Figure 13:
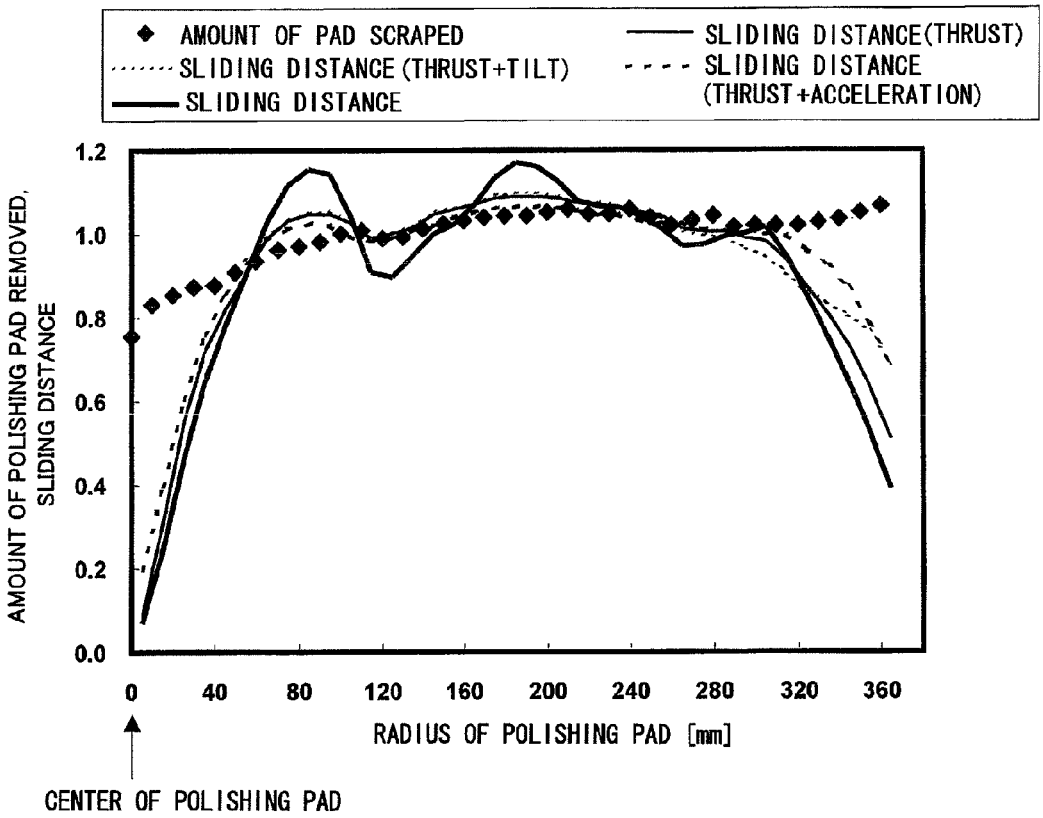
FIG. 13 is a graph showing an example of a comparison between a measurement result of the distribution of the amount of the scraped polishing pad and a simulation result of the distribution of the sliding distance obtained by the simulation reflecting the thrusting of the diamond particles into the polishing pad.

FIG. 13 is a graph showing a comparison between the simulation result of the distribution of the sliding distance according to the above-discussed method and the measurement result of the amount of the scraped polishing pad. The respective values are normalized values given by dividing an original value by an average. In FIG. 13, rhombic marks represent actual measurements of the polishing pad scraped off by the dressing operation, a thick solid line represents a result of the simple calculation of the sliding distance (the same result as that in FIG. 2), a thin solid line represents a result of the simulation of the sliding distance obtained through the correction reflecting the thrusting of the diamond particles into the polishing pad, and a thin dotted line represents a result of the simulation of the sliding distance obtained through the correction reflecting the thrusting of the diamond particles into the polishing pad and the tilting of the dresser when protruding from the polishing pad. A thick dotted line represents a result of the correction of the sliding distance, calculated in consideration of the acceleration of the movement of the dresser, in consideration of the thrusting of the diamond particles into the polishing pad. In each calculation result, a in the equation (3) of the correction factor $K_1$ is set to a constant.

As can be seen from FIG. 13, compared with the result of simply calculating the sliding distance, the simulation result of the sliding distance through the correction reflecting the thrusting of the diamond particles into the polishing pad shows less undulation and shows a distribution similar to the measurement result of the amount of the scraped polishing pad. Further, the simulation result of the sliding distance through the corrections reflecting the tilting of the dresser and the acceleration of the swinging movement of the dresser, in addition to the thrusting of the diamond particles into the polishing pad, shows a greater sliding distance at the periphery of the polishing pad than the other simulation results. Therefore, the distribution in this simulation result is closer to the distribution of the actual amount of the scraped pad.

The increment $\Delta D_3$ of the sliding distance may be further corrected using the following equation (8), $$\Delta D_4 = \Delta D_3 + K_3 \times \Delta T \quad (8)$$

where $K_3$ is a correction factor which is determined using an experimental result. Specifically, the correction factor $K_3$ is selected such that a difference between an actual distribution of the amount of the scraped polishing member (i.e., an experimental result) and a simulated distribution of the amount of the polishing member to be scraped off (i.e., a simulation result) becomes small. In this case, the actual distribution of the amount of the scraped polishing member is obtained from measurement results of the amount of the polishing member that has been scraped off by the dressing operation, and the above-described simulation result is obtained from a simulation under the same dressing conditions as those of the experiment.

This correction using the above equation (8) indicates that the amount of the scraped polishing member is expressed by an approximately linear function using the sliding distance, rather than the approximately proportional relationship between the amount of the scraped polishing member and the sliding distance.

Figure 14:
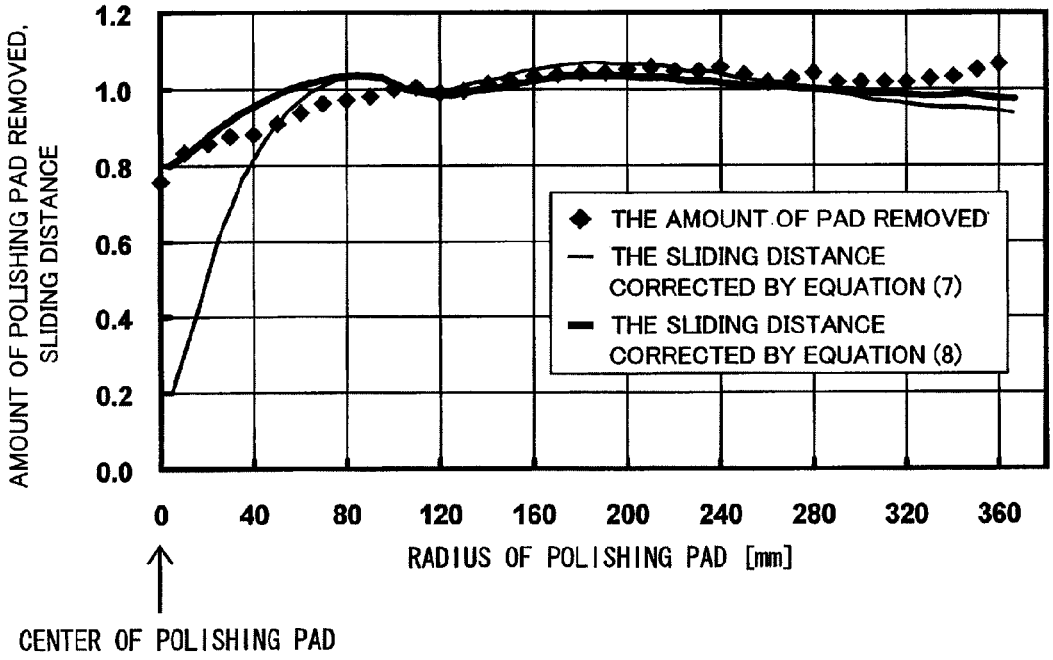
FIG. 14 is a graph showing another example of a comparison between a measurement result of the distribution of the amount of the scraped polishing pad and a simulation result of the distribution of the sliding distance obtained by the simulation reflecting the thrusting of the diamond particles into the polishing pad.

FIG. 14 is a graph showing a comparison between the measurement result of the amount of the scraped polishing pad and the simulation result of the distribution of the sliding distance according to the above-discussed corrections reflecting the thrusting of the diamond particles into the polishing pad, the tilting of the dresser when protruding from the polishing pad, and the acceleration of the swinging movement of the dresser. It can be seen from FIG. 14 that the distribution of the sliding distance and the distribution of the amount of the scraped polishing pad agree well with each other. Therefore, the simulation method according to this embodiment of the present invention can estimate the amount of the polishing pad to be scraped off more accurately than the conventional method that only simulates the distribution of the sliding distance. Further, as can be seen from a comparison between the simulation result (indicated by a thin solid line) using the equation (7) and the simulation result (indicated by a thick solid line) using the equation (8), the correction using the equation (8) can improve the accuracy of the simulation around the center of the polishing pad.

Figure 15:
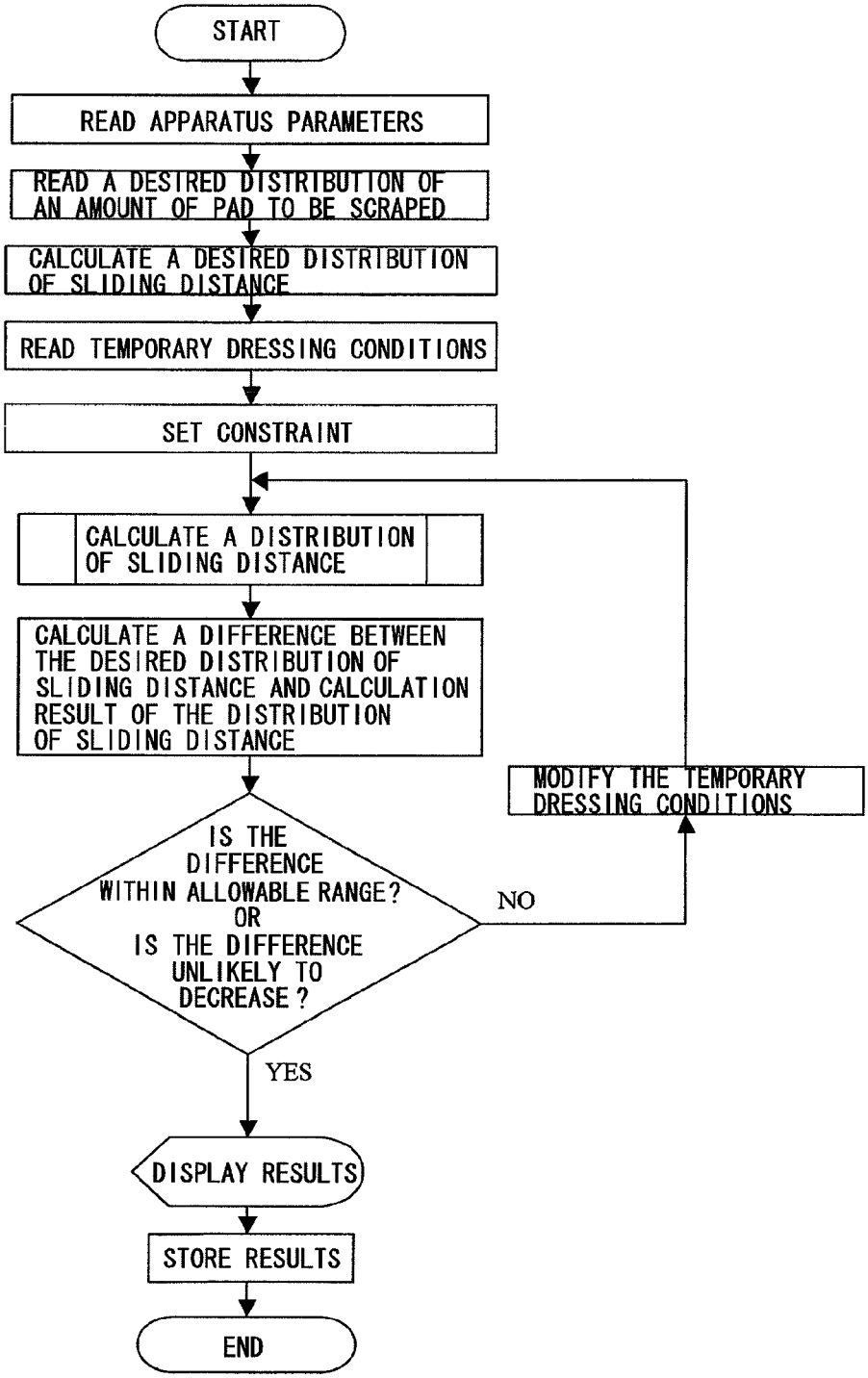
FIG. 15 is an example of a flowchart for searching the dressing conditions.

Next, a method of searching the dressing conditions using the above-described simulation method will be described with reference to FIG. 15. FIG. 15 is a flowchart for searching a desired distribution of the sliding distance that can result in a desired distribution of the amount of the scraped polishing pad by modifying temporary dressing conditions.

First, the arithmetic device 130 reads the apparatus parameters. The apparatus parameters may be described directly in a program or may be inputted from an input device, such as a keyboard. Alternatively, the arithmetic device 130 may read the apparatus parameters from a control computer of the polishing apparatus. The apparatus parameters include data on the range of the diamond particles arranged on the dresser, data on the position of the dresser pivot axis, the radius of the swinging movement of the dresser, the diameter of the polishing pad, the accelerations of the swinging movement of the dresser, and the like.

Next, the arithmetic device 130 reads a desired (i.e., preset) distribution of the amount of the polishing member to be scraped off. The desired distribution of the amount of the polishing member to be scraped off may be described directly in a program or may be inputted from an input device, such as a keyboard. A data format of the desired distribution of the amount to be scraped may be of any type so long as the relationship between the radius of the polishing member (i.e., a radial distance from the center of the polishing member) and the amount of the polishing member to be scraped off is determined uniquely. For example, table 2 shows data in which the plural radii of the polishing member and the amounts to be scraped are in one-to-one relationship. In this example, it is possible to interpolate intermediate values using a linear line or cubic spline. When the desired distribution of the amount to be scraped is a uniform distribution, such a desired uniform distribution may be described directly in a program or may be inputted from an input device.

TABLE 2

| RADIUS OF POLISHING MEMBER | AMOUNT SCRAPED |
|---|---|
| RADIUS OF POLISHING MEMBER 1 | AMOUNT SCRAPED 1 |
| RADIUS OF POLISHING MEMBER 2 | AMOUNT SCRAPED 2 |
| RADIUS OF POLISHING MEMBER 3 | AMOUNT SCRAPED 3 |
| RADIUS OF POLISHING MEMBER 4 | AMOUNT SCRAPED 4 |
| RADIUS OF POLISHING MEMBER 5 | AMOUNT SCRAPED 5 |
| RADIUS OF POLISHING MEMBER 6 | AMOUNT SCRAPED 6 |
| RADIUS OF POLISHING MEMBER 7 | AMOUNT SCRAPED 7 |
| RADIUS OF POLISHING MEMBER 8 | AMOUNT SCRAPED 8 |

Next, the arithmetic device 130 calculates a desired distribution of the sliding distance from the desired distribution of the amount to be scraped. For example, the arithmetic device 130 normalizes the desired distribution of the amount to be scraped with its average to provide a normalized desired distribution of the sliding distance. In this case, if the desired distribution of the amount to be scraped is a uniform distribution, the desired distribution of the sliding distance is expressed by 1, regardless of positions on the polishing member. Other applicable methods include a method of obtaining a desired distribution of the sliding distance by dividing the desired distribution of the amount to be scraped by a proportionality constant (conversion factor) thereof, since the sliding distance is considered to be approximately proportional to the amount to be scraped off.

Next, the arithmetic device 130 reads temporary dressing conditions as a start of searching the dressing conditions. The temporary dressing conditions may be described directly in a program or may be inputted from an input device, such as a keyboard. Alternatively, the arithmetic device 130 may read the temporary dressing conditions from the control computer of the polishing apparatus. The temporary dressing conditions include the rotational speed of the polishing member, the starting position of the swinging movement of the dresser, the range of the swinging movement of the dresser, the number of swing segments, the widths of the respective swing segments, the swinging speed of the dresser in each swing segment, the rotational speed of the dresser, the dressing load, and the dressing time.

Next, a constraint on searching of the dressing conditions is set in the arithmetic device 130. This constraint may be described directly in a program or may be inputted from an input device, such as a keyboard. Alternatively, the arithmetic device 130 may read the constraint from the control computer of the polishing apparatus. The constraint includes a lower limit and an upper limit of each of the rotational speed of the polishing member, the starting position of the swinging movement of the dresser, the range of the swinging movement of the dresser, the number of swing segments, the widths of the respective swing segments, the swinging speed of the dresser in each swing segment, the rotational speed of the dresser, the dressing load, and the dressing time. The lower limit and the upper limit may be the same value in one or more parameters. For example, the lower limit and the upper limit of the rotational speed of the polishing member may be set to be equal. In this case, the rotational speed of the polishing member is fixed to the lower limit (and the upper limit). Together with the constraint, the number of dressing operations to be repeated (i.e., the preset repetition number) is set to the arithmetic device 130.

Next, the arithmetic device 130 calculates the distribution of the sliding distance under the temporary dressing conditions. The calculation of the distribution of the sliding distance is conducted according to the method that is discussed with reference to the flowchart in FIG. 6. The inputted apparatus parameters and the inputted temporary dressing conditions are used in the calculation of the distribution of the sliding distance.

Next, the arithmetic device 130 calculates a difference between the desired distribution of the sliding distance and the calculation result of the distribution of the sliding distance. Specifically, the arithmetic device 130 calculates the sum of squares of the differences between the desired distribution of the sliding distance and the calculation result of the distribution of the sliding distance at the respective sliding-distance calculation points, or the sum of absolute values of the differences therebetween. In this calculation, a range of the sliding-distance calculation points may be limited.

Next, the arithmetic device 130 judges whether the difference between the desired distribution of the sliding distance and the calculation result of the distribution of the sliding distance is within an allowable range, or whether modification of the temporary dressing conditions does not make the difference smaller significantly any more. When the arithmetic device 130 judges that the difference is not within the allowable range and the difference becomes even smaller significantly by the modification of the temporary dressing conditions, the arithmetic device 130 modifies the temporary dressing conditions and repeats the calculation of the distribution of the sliding distance again. When the arithmetic device 130 judges that the difference is within the allowable range and the difference does not become smaller significantly by further modification of the temporary dressing conditions, the arithmetic device 130 determines the temporary dressing conditions to be the desired dressing conditions and performs the ending processes, such as display and storing of the results.

Design of experiments or commercially-available optimizing tool can be used for searching the dressing conditions. For example, Minitab, developed by Minitabl Inc., or MATLAB Optimization Toolbox, developed by MathWorks Inc., can be used.

Figure 16:
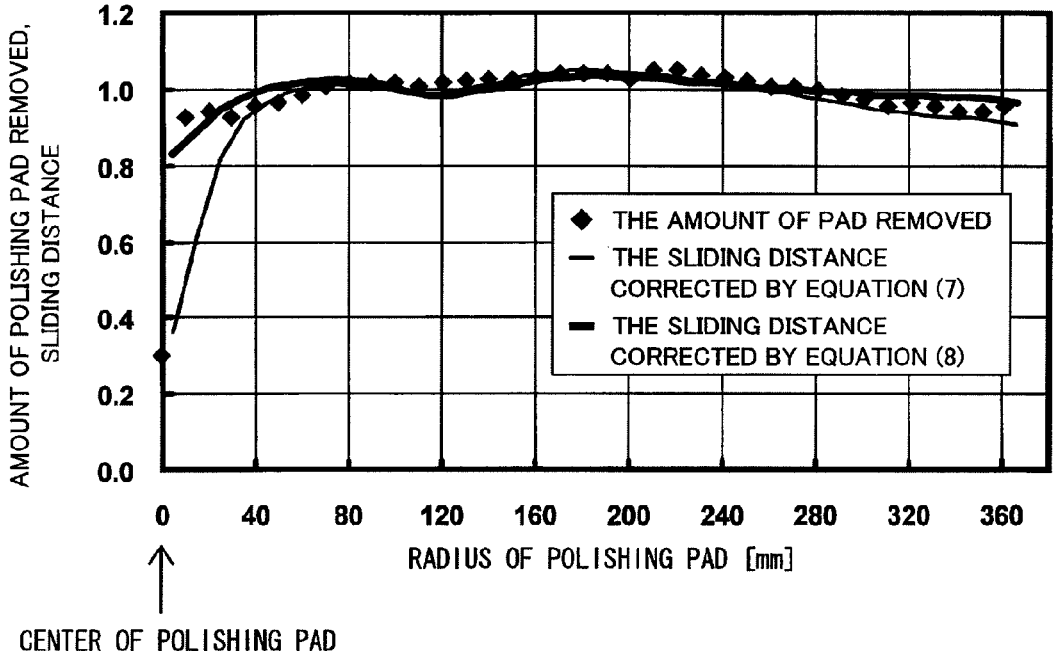
FIG. 16 a graph showing a simulation result of the distribution of the sliding distance using the dressing conditions searched and a measurement result of the distribution of the amount of the polishing pad scraped off by the dressing operation using the dressing conditions searched.

Next, the result of the dressing conditions searched by using the above-described dressing-condition searching method will be described. Searching of the dressing conditions for realizing a uniform distribution of the amount of the scraped polishing pad was conducted under a constraint in which only the rotational speed of the dresser was changed from the dressing conditions in FIG. 14 and other dressing conditions were unchanged. FIG. 16 shows a simulation result of the distribution of the sliding distance using the searching result of the dressing conditions and a measurement result of the distribution of the amount of the polishing pad scraped off by the dressing operation using the searching result of the dressing conditions. In FIG. 16, a thin solid line represents the simulation result using the equation (7) and a thick solid line represents the simulation result using the equation (8). Compared with the graph shown in FIG. 14, it can be seen that the dressing conditions (i.e., the rotational speed of the dresser in this example) are optimized such that the sliding distance and the amount of the scraped pad become uniform, particularly in a region where the radial distance from the center of the polishing pad is small. From these results, the validity of this method can be confirmed. In FIG. 14 and FIG. 16, the sliding distance and the amount of the scraped pad are expressed in normalized values obtained using their averages.

Figure 17:
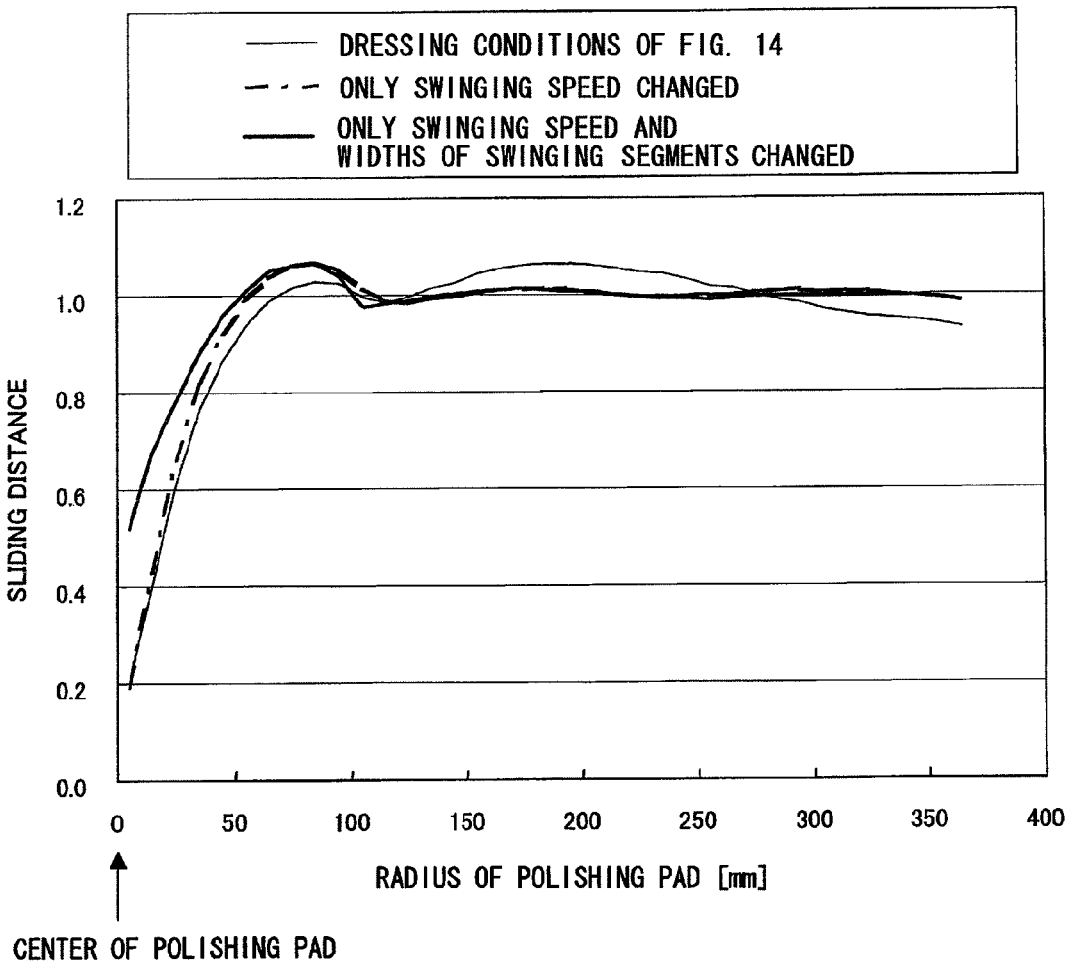
FIG. 17 a graph showing another example of simulation results of the distribution of the sliding distance using the dressing conditions searched.

Next, with use of the above-described dressing-condition searching method, searching of the dressing conditions for realizing a uniform distribution of the amount of the scraped polishing pad was conducted under a constraint in which only the swinging speed of the dresser was changed from the dressing conditions in FIG. 14 and other dressing conditions were unchanged. Further, searching of the dressing conditions for realizing a uniform distribution of the amount of the scraped polishing pad was conducted under a constraint in which only the swinging speed of the dresser and the widths of the swing segments of the dresser were changed from the dressing conditions in FIG. 14 and other dressing conditions were unchanged. FIG. 17 shows simulation results of the distribution of the sliding distance using the respective searching results of the dressing conditions. In FIG. 17, a thin solid line represents the distribution of the sliding distance under the dressing conditions of FIG. 14, a thick dashed line represents the distribution of the sliding distance under the dressing conditions in which only the swinging speed of the dresser was changed, and a thick solid line represents the distribution of the sliding distance under the dressing conditions in which only the swinging speed of the dresser and the widths of the swing segments of the dresser were changed. It can be seen that, compared with the dressing conditions of FIG. 14, a more uniformed distribution of the sliding distance can be obtained by this method particularly in a region where the radial distance from the center of the polishing pad is 100 mm or more. In FIG. 17, the sliding distance is expressed in normalized values obtained using its average.

Figure 18:
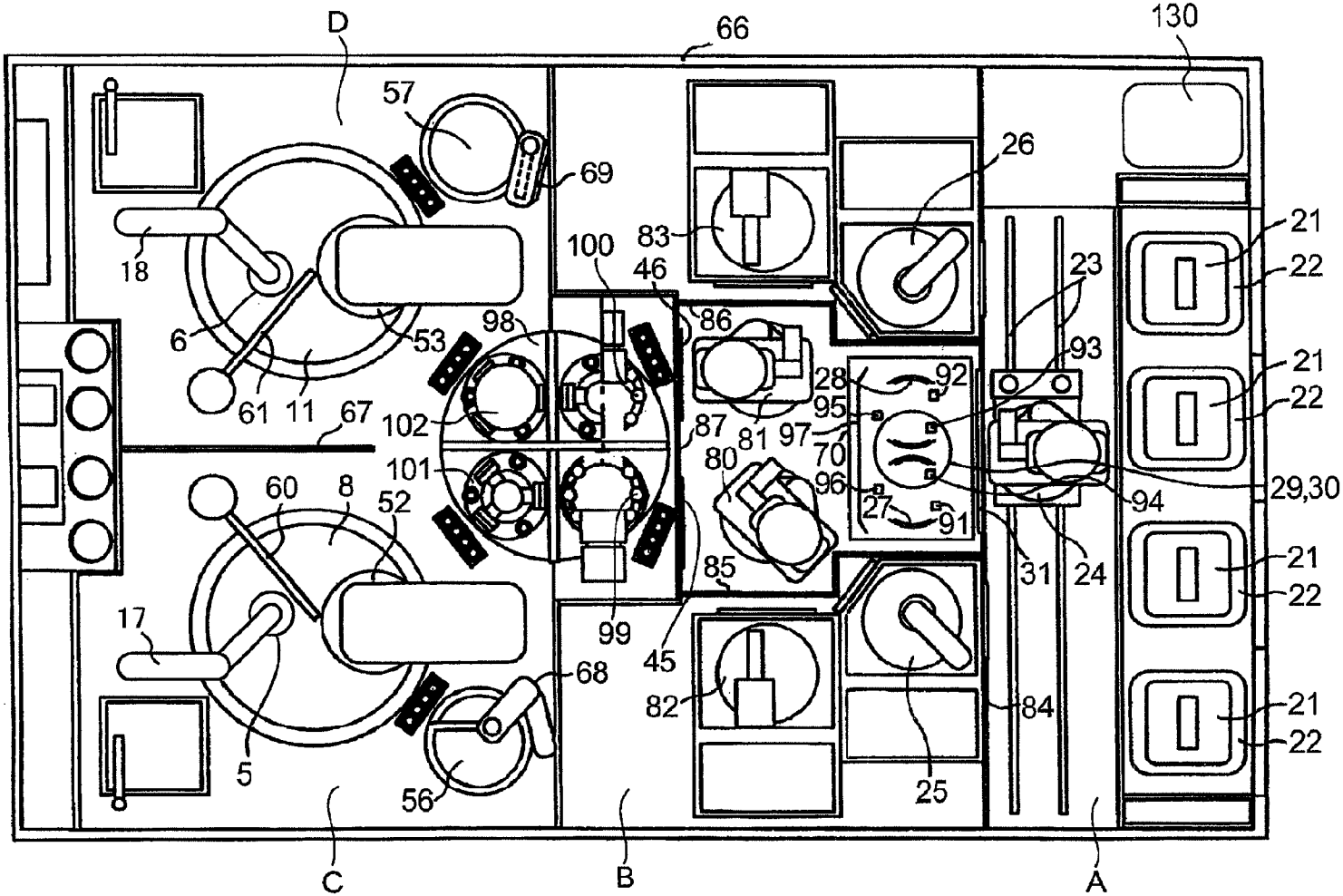
FIG. 18 is a plan view showing a polishing apparatus according to an embodiment of the present invention.

FIG. 18 is a plan view showing the layout of a polishing apparatus, for mainly polishing a semiconductor wafer, according to an embodiment of the present invention. As shown in FIG. 18, the polishing apparatus has four load/unload stages 22 each for loading a wafer cassette 21 which accommodates a number of semiconductor wafers (objects to be polished) therein. The load/unload stages 22 may have a lifting and lowering mechanism. A transport robot 24, having two hands, is provided on moving mechanisms 23 so that the transport robot 24 can access the respective wafer cassettes 21 on the respective load/unload stages 22.

The transport robot 24 has upper and lower hands. The lower hand of the transport robot 24 is used only for receiving a semiconductor wafer from the wafer cassette 21. The upper hand of the transport robot 24 is used for returning a semiconductor wafer to the wafer cassette 21. Since a clean semiconductor wafer, which has been cleaned, is held by the upper hand, the clean semiconductor wafer is not contaminated. The lower hand is a vacuum attracting-type hand for holding a semiconductor wafer via vacuum, and the upper hand is a recess support-type hand for supporting a peripheral edge of a semiconductor wafer. The vacuum attracting-type hand can hold and transport a semiconductor wafer even if the semiconductor wafer is not located in a normal position in the wafer cassette 21. The recess support-type hand can transport a semiconductor wafer while keeping a lower surface of the semiconductor wafer clean because dust is not collected unlike the vacuum attracting-type.

Two cleaning machines 25, 26 are disposed at an opposite side of the wafer cassettes 21 with respect to the moving mechanisms 23 of the transport robot 24. The cleaning machines 25, 26 are disposed at positions accessible by the hands of the transport robot 24. Between the two cleaning machines 25, 26, a wafer station 70 having four semiconductor wafer supports 27, 28, 29 and 30 is disposed at a position accessible by the transport robot 24. Each of the cleaning machines 25, 26 has a spin-dry mechanism for drying a semiconductor wafer by spinning it at a high speed. Hence, two-stage cleaning and three-stage cleaning of a semiconductor wafer can be performed without replacing any cleaning module.

An area B, in which the cleaning machines 25, 26 and the supports 27, 28, 29 and 30 are disposed, and an area A, in which the wafer cassettes 21 and the transport robot 24 are disposed, are partitioned by a partition 84 so that the cleanliness in the area A and the area B can be separated. The partition 84 has an opening for allowing semiconductor wafers to pass therethrough, and a shutter 31 is provided at the opening of the partition 84. A transport robot 80, having two hands, is disposed at a position where the transport robot 80 can access the cleaning machine 25 and the three supports 27, 29 and 30, and a transport robot 81, having two hands, is disposed at a position where the transport robot 81 can access the cleaning machine 26 and the three supports 28, 29 and 30.

The support 27 is used to transfer a semiconductor wafer between the transport robot 24 and the transport robot 80, and has a sensor 91 for detecting existence of a semiconductor wafer. The support 28 is used to transfer a semiconductor wafer between the transport robot 24 and the transport robot 81, and has a sensor 92 for detecting existence of a semiconductor wafer. The support 29 is used to transport a semiconductor wafer from the transport robot 81 to the transport robot 80, and has a sensor 93 for detecting existence of a semiconductor wafer and a rinsing nozzle 95 for preventing a semiconductor wafer from being dried or for cleaning a semiconductor wafer.

The support 30 is used to transport a semiconductor wafer from the transport robot 80 to the transport robot 81, and has a sensor 94 for detecting existence of a semiconductor wafer and a rinsing nozzle 96 for preventing a semiconductor wafer from being dried or for cleaning a semiconductor wafer. The supports 29, 30 are disposed in a common water-scatter-prevention cover which has an opening defined therein for transporting wafers therethrough. At the opening, there is provided a shutter 97. The support 29 is disposed above the support 30. The support 29 serves to support a semiconductor wafer which has been cleaned, and the support 30 serves to support a semiconductor wafer to be cleaned. With this arrangement, the semiconductor wafer is prevented from being contaminated by rinsing water which would otherwise fall thereon. It is noted that the sensors 91, 92, 93 and 94, the rinsing nozzles 95, 96, and the shutter 97 are schematically shown in FIG. 18 and their positions and shapes are not exactly illustrated.

The respective upper hands of the transport robots 80, 81 are used for transporting a semiconductor wafer, that has been cleaned, to the cleaning machines 25, 26 or the supports of the wafer station 70. The respective lower hands of the transport robots 80, 81 are used for transporting a semiconductor wafer, that has not been cleaned or a semiconductor wafer to be polished, to a reversing device. Since the lower hands are used to transport a semiconductor wafer to or from the reversing device, the upper hands are not contaminated by drops of rinsing water which falls from an upper wall of the reversing device. A cleaning machine 82 is disposed at a position adjacent to the cleaning machine 25 and accessible by the hands of the transport robot 80. Further, a cleaning machine 83 is disposed at a position adjacent to the cleaning machine 26 and accessible by the hands of the transport robot 81. All of the cleaning machines 25, 26, 82 and 83, the supports 27, 28, 29 and 30 of the wafer station 70, and the transport robots 80, 81 are placed in the area B. Pressure in the area B is adjusted to be lower than pressure in the area A. Each of the cleaning machines 82, 83 is capable of cleaning both surfaces of a semiconductor wafer.

The polishing apparatus has a housing 66 for enclosing various components therein. The interior of the housing 66 is partitioned into a plurality of compartments or chambers (including the areas A and B) by partitions 84, 85, 86, 87 and 67. A polishing chamber is separated from the area B by the partition 87, and the polishing chamber is divided into an area C as a first polishing section and an area D as a second polishing section. In each of the two areas C, D, there are provided two polishing tables, and a single top ring for holding a semiconductor wafer and pressing the semiconductor wafer against the polishing tables for polishing. That is, polishing tables 8, 56 are provided in the area C, and polishing tables 11, 57 are provided in the area D. Further, a top ring 52 is provided in the area C, and a top ring 53 is provided in the area D.

The polishing tables 8, 11, 56, 57 are each provided at its top with the polishing pad 10 (see FIG. 3) as the polishing member. An upper surface of the polishing pad 10 provides a polishing surface. The polishing tables may have different types of polishing pads according to purpose of the polishing process. In the area C are disposed an abrasive liquid nozzle 60 for supplying a polishing abrasive liquid to the polishing table 8 and the diamond dresser 5 for dressing the polishing table 8. In the area D are disposed an abrasive liquid nozzle 61 for supplying a polishing abrasive liquid to the polishing table 11 and a diamond dresser 6 for dressing the polishing table 11.

Each of the diamond dressers 5 and 6 is a small-diameter dresser having a diameter smaller than a semiconductor wafer, and has the dressing surface provided with the diamond particles thereon (this surface is brought into contact with the polishing pad). The diamond dressers 5 and 6 are located near tip ends of pivotable dresser arms 17 and 18, respectively. Therefore, pivoting motion of the dresser arms 17 and 18 cause the diamond dressers 5 and 6 to swing on the polishing tables 8 and 11. The diamond dressers 5 and 6 and the dresser arms 17 and 18 constitute the dressing units (see reference numeral 12 in FIG. 3).

Wet-type wafer film thickness-measuring machines may be installed in place of the polishing tables 56, 57. In this case, it is possible to measure with the wafer film thickness-measuring machine a thickness of a surface film of a semiconductor wafer immediately after polishing, making it possible to additionally polish the surface film of the semiconductor wafer or to control the polishing process of the next semiconductor wafer by utilizing a measurement value of the film thickness.

In order to transfer a semiconductor wafer between the polishing chamber and the area B, a rotary wafer station 98, having reversing machines 99, 100, 101, 102 for reversing a semiconductor wafer, is disposed at a position accessible by the transport robots 80, 81 and the top rings 52, 53. The reversing machines 99, 100, 101, 102 revolve by rotation of the rotary wafer station 98.

A semiconductor wafer is transferred between the polishing chamber and the area B in the following manner. Assuming that the reversing machines 99, 100, 101, 102, provided in the rotary wafer station 98, are disposed as shown in FIG. 18, i.e., the reversing machines 99, 100 are disposed on the area B side of the rotary wafer station 98, the reversing machine 101 on the area C side and the reversing machine 102 on the area D side, a semiconductor wafer to be polished is transferred by the transport robot 80 from the wafer station 70 to the reversing machine 99 disposed on the area B side of the rotary wafer station 98. Another semiconductor wafer is transferred by the transport robot 81 from the wafer station 70 to the reversing machine 100 disposed on the area B side of the rotary wafer station 98.

A shutter 45, provided on the partition 87, opens when the transport robot 80 transports a semiconductor wafer to the rotary wafer station 98, so that the semiconductor wafer can be transferred between the area B and the polishing chamber. A shutter 46, provided on the partition 87, opens when the transport robot 81 transports a semiconductor wafer to the rotary wafer station 98, so that the semiconductor wafer can be transferred between the area B and the polishing chamber.

After transferring the semiconductor wafer to the reversing machine 99 and transferring the another semiconductor wafer to the reversing machine 100, the rotary wafer station 98 is rotated about its axis by 180 degrees to thereby move the reversing machine 99 to the area D side and move the reversing machine 100 to the area C side. The semiconductor wafer, which has been moved to the area C side by the rotation of the rotary wafer station 98, is reversed by the reversing machine 100 such that its surface to be polished (front surface) faces downward, and then transferred to the top ring 52. The semiconductor wafer, which has been moved to the area D side by the rotation of the rotary wafer station 98, is reversed by the reversing machine 99 such that its surface to be polished (front surface) faces downward, and then transferred to the top ring 53.

The semiconductor wafers, which have been transferred to the top rings 52, 53, are attracted to the top rings 52, 53 by their vacuum attraction mechanisms. The semiconductor wafers, while kept attracted to the top rings 52, 53, are transported to the polishing tables 8, 11, and are polished with the polishing pads 10 of the polishing tables 8, 11.

Figure 19:
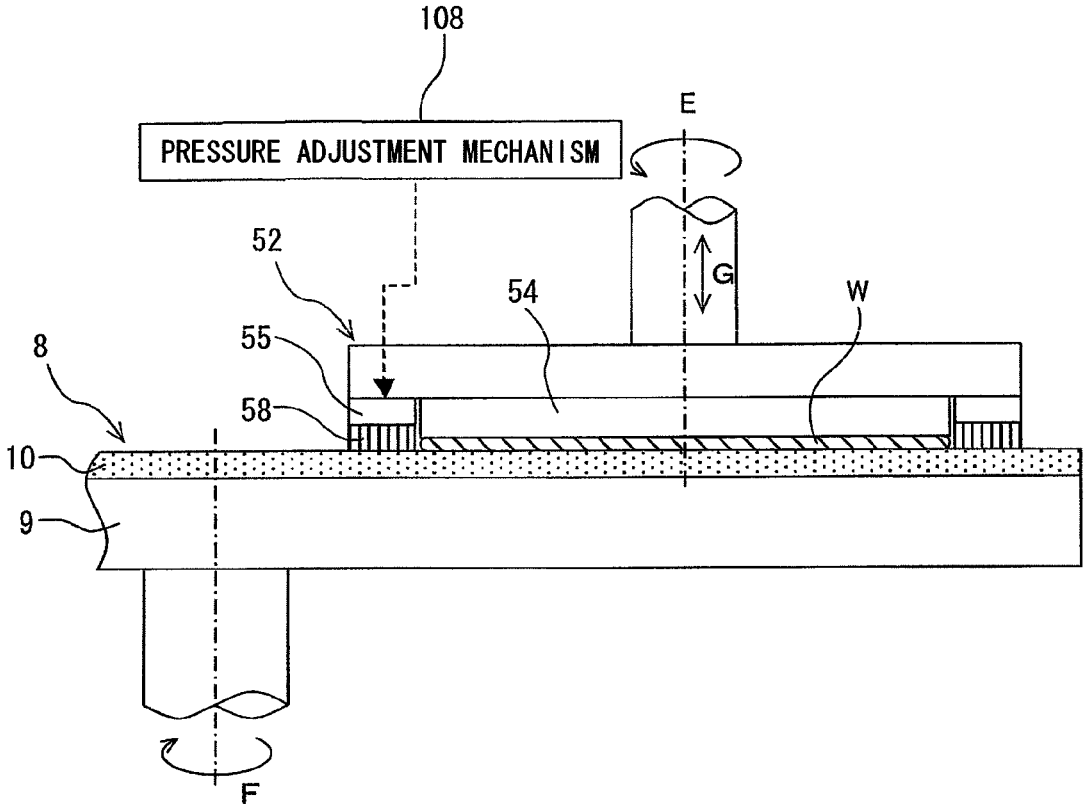
FIG. 19 is a schematic cross-sectional view illustrating a top ring and part of a polishing table.

FIG. 19 is a schematic cross-sectional view illustrating the top ring 52 and part of the polishing table 8 during polishing. The top ring 53 and the polishing table 11 have the same structures. As shown in FIG. 19, the top ring 52, which is a holder for a semiconductor wafer W as a polishing object, includes an air bag 54 for pressing the semiconductor wafer W against the polishing member (polishing pad) 10 at predetermined pressure, a support section (retainer ring) 58 provided so as to surround the semiconductor wafer W, and an air bag 55 for pressing the retainer ring 58 against a portion of the polishing pad 10 around the semiconductor wafer W at predetermined pressure.

As shown in FIG. 19, the retainer ring 58 of this embodiment is a one-piece member having a rectangular cross-sectional shape and an annular plan shape extending along the circumference of the semiconductor wafer W. A slight gap is formed between the retainer ring 58 and the periphery of the semiconductor wafer W held by the top ring 52. A lower surface of the retainer ring 58 forms a support surface for supporting the portion of the polishing pad 10 lying around the surface (to be polished) of the semiconductor wafer W, and is a substantially flat surface in its entity. The retainer ring 58 may be formed of, for example, a ceramic material (e.g., zirconia or alumina) or an engineering plastic material (e.g., an epoxy (EP) resin, a phenol (PF) resin, or a polyphenylene sulfide (PPS) resin).

The pressure of the retainer ring 58 against the polishing pad 10 is adjusted by controlling the pressure in the air bag 55 by a pressure adjustment mechanism 108. It is possible not to provide the air bag 55, and adjust the pressure of the support surface of the retainer ring 58 by controlling the load, applied from the shaft of the top ring 52, by the pressure adjustment mechanism (e.g., an air cylinder) 108. The air bag 54 may be either a single chamber, as illustrated in FIG. 19, or a plurality of concentric chambers.

As shown in FIG. 19, the polishing table 8 has the polishing platen 9 and the polishing pad 10. The polishing pad 10 may be either a single-layer pad or a multi-layer pad with two or more layers. The top ring 52 is movable by a driving mechanism (not shown in the drawing) in directions perpendicular to the polishing surface of the polishing pad 10 (indicated by arrow G). During polishing, the top ring 52 is rotated by a rotating mechanism (not shown in the drawing) about its rotational shaft in a direction of arrow E, while pressing the semiconductor wafer W against the polishing pad 10. The polishing table 8 is also rotated about its rotational shaft in a direction of arrow F during polishing. It is noted that the rotating directions are not limited to those indicated by the arrows E and F. In this manner, the top ring 52 and the polishing platen 9 cause relative movement between the semiconductor wafer W and the polishing pad 10 to thereby polish the surface of the semiconductor wafer W.

Referring back to FIG. 18, the second polishing tables 56, 57 are disposed respectively at positions accessible by the top rings 52, 53, so that semiconductor wafers, after completion of the polishing in the first polishing tables 8, 11, can be polished with the finishing polishing pads of the second polishing tables 56, 57. In the second polishing tables 56, 57, polishing of the respective semiconductor wafers in the finishing tables is carried out by supplying pure water or a chemical solution with no abrasive particles, or a slurry to the respective polishing pads, for example, SUBA 400 or Polytex (trade names of polishing pads manufactured by NITTA HAAS Incorporated). During polishing, new semiconductor wafers to be polished may be transferred by the transport robots 81, 80 to the reversing machines 101, 102 which have been moved to the area B side.

The semiconductor wafers after completion of the polishing are transferred by the top rings 52, 53 to the reversing machines 99, 100, respectively. The reversing machines 99, 100 reverse the semiconductor wafers such that the surfaces (polished surfaces) face upward. Then, the rotary wafer station 98 is rotated through 180 degrees to thereby move the semiconductor wafers to the area B side of the rotary wafer station 98. One of the semiconductor wafers, which have been moved to the area B side, is transported by the transport robot 80 from the reversing machine 99 to the cleaning machine 82 or the wafer station 70. The other semiconductor wafer is transported by the transport robot 81 from the reversing machine 100 to the cleaning machine 83 or the wafer station 70. After carrying out appropriate cleaning of the semiconductor wafers, the semiconductor wafers are placed into the wafer cassette 21.

After the completion of polishing with the polishing tables 8, 11, the polishing pads 10, which provide the uppermost surfaces of the polishing tables 8, 11, are dressed by the dressers 5, 6 (see FIG. 3). During dressing, the abrasive liquid nozzles 60, 61 supply a cleaning liquid, such as pure water, to the polishing pads 10. By the dressing operations, cleaning, conditioning, configuration correction, etc. of the polishing surfaces of the polishing pads are performed.

In each dressing operation, the polishing apparatus performs dressing of the polishing surface under the predetermined pressing conditions (dressing recipe) i.e., the combination of the determined rotational speed of the polishing pad, the determined rotational speed of the dresser, the determined dressing load, the determined dresser swing segments, the determined dresser swinging speed, and the like. In this embodiment, the dressing conditions are determined by the arithmetic device 130.

As shown in FIG. 3, in this polishing apparatus, the dressing operation is performed by rotating the polishing pad 10 by the non-illustrated rotating mechanism in the direction of the arrow I at the predetermined rotational speed and bringing the dressing surface (i.e., the surface with the diamond particles) of the diamond dresser 5 into contact with the polishing pad 10 at the predetermined dressing load, while rotating the diamond dresser 5 by the non-illustrated rotating mechanism in the direction of the arrow H at the predetermined rotational speed. It is noted that the rotating directions are not limited to those indicated by the arrows I and H. Further, the dresser 5 on the polishing pad 10 is swung by the dresser arm 17 to thereby dress the area of the polishing pad 10 used in the polishing operation (i.e., the polishing area). In the example shown in FIG. 3, the dressing unit 12 is constituted by the dresser 5, the universal joint 15, the dresser rotational shaft 16, and the dresser arm 17.

Dressing of the polishing pad 10 is performed so as to provide a desired distribution of the amount of the scraped polishing pad under the dressing conditions (i.e., dressing recipe) determined by using the sliding-distance-distribution simulation that reflects the thrusting of the diamond particles into the polishing pad. The dressing conditions (i.e., dressing recipe) are the combination of the rotational speed of the polishing pad, the rotational speed of the dresser, the dressing load, the dresser swing segments, the dresser moving (swinging) speed, the dressing time, and the like.

The simulation of the distribution of the sliding distance, which reflects the thrusting of the diamond particles into the polishing pad, is carried out by the arithmetic device 130 shown in FIG. 18. The desired distribution of the amount of the polishing pad to be scraped off is inputted into the arithmetic device 130 from the input device (not shown). Then, the arithmetic device 130 performs a step of determining the desired distribution of the sliding distance of the diamond dresser from the desired distribution of the amount of the polishing pad to be scraped off, a step of calculating the sliding distance of the diamond dresser using the temporary dressing conditions, a step of correcting the calculated sliding distance based on the thrusting of the diamond particles into the polishing pad, a step of further correcting the corrected sliding distance based on the tilting of the dresser, and a step of searching the dressing conditions that can result in a distribution of the sliding distance close to the desired distribution of the sliding distance by modifying the temporary dressing conditions. Then, the arithmetic device 130 controls the dressing unit 12 such that the dressing unit 12 performs the dressing operations under the dressing conditions obtained as a result of the above-described searching step for the desired distribution of the sliding distance.

The step of determining the desired distribution of the sliding distance of the diamond dresser from the desired distribution of the amount of the polishing pad to be scraped off, the step of calculating the sliding distance of the diamond dresser using the temporary dressing conditions, the step of correcting the calculated sliding distance based on the thrusting of the diamond particles into the polishing pad, the step of further correcting the corrected sliding distance based on the tilting of the dresser, and the step of searching the dressing conditions that can result in a distribution of the sliding distance close to the desired distribution of the sliding distance by modifying the temporary dressing conditions are performed by the method as discussed with reference to FIG. 6 and FIG. 15.

In the example shown in FIG. 18, the arithmetic device 130, together with the polishing tables and the dressers, is disposed in the housing 66. However, the arrangement of the arithmetic device 130 is not limited to this embodiment. For example, the arithmetic device 130 may be installed in other facility. In this case, the above-described simulation process and the searching process for the dressing conditions can be performed by the arithmetic device 130, and the resultant dressing conditions can be inputted into the controller (not shown) for controlling the operations of the polishing apparatus via an electric communication or an input device (not shown).

In the above-described embodiment, the dresser pivots on the dresser pivot axis as shown in FIG. 1. However, the present invention can be applied to other embodiments in which the dresser performs a linear reciprocating movement or other movements. Further, the present invention is not limited to the embodiment in which the polishing member rotates as shown in FIG. 1, and can be applied to other embodiments in which the polishing member moves in a chain track (an endless path).

What is claimed is:

1. A method of dressing a polishing member with a diamond dresser while moving the diamond dresser and the polishing member relative to each other, the diamond dresser having diamond particles arranged on a surface thereof, said method comprising:

calculating sliding distances of the diamond dresser at respective predefined points on a surface of the polishing member using temporary dressing conditions;

correcting the calculated sliding distances in accordance with a depth of the diamond particles thrusting into the polishing member such that differences between the calculated sliding distances are reduced;

modifying the temporary dressing conditions based on the corrected sliding distances;

searching dressing conditions for a preset distribution of the sliding distances from the modified temporary dressing conditions; and dressing the polishing member with the diamond dresser under the dressing conditions searched, wherein said correcting of the calculated sliding distances is performed by multiplying the calculated sliding distances by correction factors, respectively, which vary such that the differences between the calculated sliding distances are reduced.

2. The method of dressing the polishing member according to claim 1, further comprising correcting the corrected sliding distances in accordance with tilting of the diamond dresser when the diamond dresser protrudes from the polishing member.

3. The method of dressing the polishing member according to claim 1, wherein said calculating of the sliding distances of the diamond dresser comprises calculating the sliding distances of the diamond dresser in accordance with an acceleration of movement of the diamond dresser.

4. A method of determining dressing conditions for use in dressing a polishing member with a diamond dresser while moving the diamond dresser and the polishing member relative to each other, the diamond dresser having diamond particles arranged on a surface thereof, said method comprising:

calculating, with a controller, sliding distances of the diamond dresser at respective predefined points on a surface of the polishing member using temporary dressing conditions;

correcting the calculated sliding distances in accordance with a depth of the diamond particles thrusting into the polishing member such that differences between the calculated sliding distances are reduced;

modifying the temporary dressing conditions based on the corrected sliding distances; and searching dressing conditions for a preset distribution of the sliding distances from the modified temporary dressing conditions, wherein said correcting of the calculated sliding distances is performed by multiplying the calculated sliding distances by correction factors, respectively, which vary such that the differences between the calculated sliding distances are reduced.

5. The method of determining the dressing conditions according to claim 4, further comprising correcting the corrected sliding distances in accordance with tilting of the diamond dresser when the diamond dresser protrudes from the polishing member.

6. The method of determining the dressing conditions according to claim 4, wherein said calculating of the sliding distances of the diamond dresser comprises calculating the sliding distances of the diamond dresser in accordance with an acceleration of movement of the diamond dresser.

7. A non-transitory computer-readable storage medium having stored thereon a program for determining dressing conditions for use in dressing of a polishing member with a diamond dresser while moving the diamond dresser and the polishing member relative to each other, the diamond dresser having diamond particles arranged on a surface thereof, said program causing a computer to execute a method comprising:

calculating sliding distances of the diamond dresser at respective predefined points on a surface of the polishing member using temporary dressing conditions;

correcting the calculated sliding distances in accordance with a depth of the diamond particles thrusting into the polishing member such that differences between the calculated sliding distances are reduced;

modifying the temporary dressing conditions based on the corrected sliding distances; and searching dressing conditions for a preset distribution of the sliding distances from the modified temporary dressing conditions, wherein said correcting of the calculated sliding distances is performed by multiplying the calculated sliding distances by correction factors, respectively, which vary such that the differences between the calculated sliding distances is reduced.

8. The non-transitory computer-readable storage medium having stored thereon said program for determining the dressing conditions according to claim 7, said program causing the computer to execute the method further comprising correcting the corrected sliding distances in accordance with tilting of the diamond dresser when the diamond dresser protrudes from the polishing member.

9. The non-transitory computer-readable storage medium having stored thereon said program for determining the dressing conditions according to claim 7, wherein said calculating of the sliding distances of the diamond dresser comprises calculating the sliding distances of the diamond dresser in accordance with an acceleration of movement of the diamond dresser.

10. A polishing apparatus comprising:

a first relative-movement mechanism configured to bring a workpiece to be polished and a polishing member into sliding contact with each other;

a dressing unit having a diamond dresser configured to dress the polishing member, said diamond dresser having diamond particles arranged on a surface thereof;

a second relative-movement mechanism configured to move said diamond dresser and the polishing member relative to each other; and an arithmetic device configured to determine dressing conditions for realizing a preset distribution of an amount of the polishing member scraped off by said diamond dresser using a distribution of sliding distances of said diamond dresser, wherein said arithmetic device is configured to calculate the sliding distances of said diamond dresser at respective predefined points on a surface of the polishing member and correct the calculated sliding distances in accordance with a depth of said diamond particles thrusting into the polishing member such that differences between the calculated sliding distances are reduced, wherein said dressing unit is configured to dress the polishing member under the dressing conditions determined by said arithmetic device, and wherein said arithmetic device is configured to correct the calculated sliding distances by multiplying the calculated sliding distances by correction factors, respectively, which vary such that the differences between the calculated sliding distances are reduced.

11. The polishing apparatus according to claim 10, wherein said arithmetic device is configured to further correct the corrected sliding distances in accordance with tilting of said diamond dresser when said diamond dresser protrudes from the polishing member.

12. The polishing apparatus according to claim 10, wherein said arithmetic device is configured to calculate the sliding distances in accordance with an acceleration of movement of said diamond dresser.

* * * * *